US007556335B2

(12) United States Patent
Yamasaki et al.

(10) Patent No.: US 7,556,335 B2
(45) Date of Patent: Jul. 7, 2009

(54) PRINT-CONTROL METHOD, PRINTING SYSTEM, AND PRINT-CONTROL APPARATUS

(75) Inventors: Keigo Yamasaki, Nagano-ken (JP); Masahiko Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 376 days.

(21) Appl. No.: 11/190,079

(22) Filed: Jul. 27, 2005

(65) Prior Publication Data

US 2006/0033770 A1 Feb. 16, 2006

(30) Foreign Application Priority Data

Jul. 27, 2004 (JP) ..... 2004-219106

(51) Int. Cl.
*B41J 29/393* (2006.01)
*B41J 29/38* (2006.01)

(52) U.S. Cl. ..... 347/19; 347/16; 347/14

(58) Field of Classification Search ..... 347/16, 347/19, 15, 14
See application file for complete search history.

(56) References Cited

U.S. PATENT DOCUMENTS 6,250,734 B1 * 6/2001 Otsuki ..... 347/16
7,347,524 B2 * 3/2008 Yoshida ..... 347/19
2004/0160469 A1 * 8/2004 Endo ..... 347/14

FOREIGN PATENT DOCUMENTS

JP 2-54676 A 2/1990

* cited by examiner

*Primary Examiner*—Julian D Huffman
*Assistant Examiner*—Jason S Uhlenhake
(74) *Attorney, Agent, or Firm*—Sughrue Mion, PLLC

(57) ABSTRACT

Quality of a printed image is improved while minimizing the amount of memory used. For example, a print-control method includes: a first print-control step of repeatedly performing a unit image formation operation of forming a unit image in a unit area on a medium by ejecting ink from nozzles arranged in a predetermined direction and moved in a movement direction, and a first carrying operation of carrying the medium by a predetermined carry amount, to print an image in an end portion, in a carrying direction, of the medium; and a second print-control step of repeatedly performing the unit image formation operation and a second carrying operation of carrying the medium by another predetermined carry amount, to print an image in an intermediate portion, in the carrying direction, of the medium. Darkness of each of the unit images within a mixed range, in which unit images printed in the first print-control step and unit images printed in the second print-control step are mixed, is corrected based on a correction value used in the second print-control step.

7 Claims, 24 Drawing Sheets

TM

| | | | |
|---|---|---|---|
| 1 | 9 | 3 | 11 |
| 13 | 5 | 15 | 7 |
| 4 | 12 | 2 | 10 |
| 16 | 8 | 14 | 6 |

UM

| | | | |
|---|---|---|---|
| 16 | 8 | 14 | 6 |
| 4 | 12 | 2 | 10 |
| 13 | 5 | 15 | 7 |
| 1 | 9 | 3 | 11 |

| | darkness data | | | |
|---|---|---|---|---|
| record number | C | M | Y | K |
| 1(R1) | | | | |
| 2(R2) | | | | |
| 3(R3) | | | | |
| 4(R4) | | | | |
| 5(R5) | | | | |
| 6(R6) | | | | |
| 7(R7) | | | | |
| 8(R8) | | | | |
| 9(R9) | | | | |
| | | | | |

Fig.17

| | correction value H | | | | |
|---|---|---|---|---|---|
| record number | C | M | Y | K | |
| 1(R1) | | | | | GR1 |
| 2(R2) | | | | | |
| ⋮ | | | | | |
| 7(R7) | | | | | |
| 8(R8) | | | | | |
| 9(C1) | | | | | GR2 |
| 10(C2) | | | | | |
| 11(C3) | | | | | |
| 12(C4) | | | | | |
| 13(C5) | | | | | |
| 14(RL−7) | | | | | GR3 |
| 15(RL−6) | | | | | |
| ⋮ | | | | | |
| 20(RL−1) | | | | | |
| 21(RL) | | | | | |

Fig.18

PRINT-CONTROL METHOD, PRINTING SYSTEM, AND PRINT-CONTROL APPARATUS

CROSS-REFERENCE TO RELATED APPLICATIONS

The present application claims priority upon Japanese Patent Application No. 2004-219106 filed on Jul. 27, 2004, which is herein incorporated by reference.

BACKGROUND OF THE INVENTION

1. Field of the Invention

The present invention relates to print-control methods, printing systems, and print-control apparatuses.

2. Description of the Related Art

Inkjet printers that form dots by ejecting ink onto a medium (paper, cloth, OHP sheet, etc.) are known as printing apparatuses for printing an image (hereinafter, these are referred simply as "printers"). Such printers perform a dot formation operation by for example ejecting ink while moving a plurality of nozzles in a movement direction. Raster lines are formed on the medium in the movement direction of the nozzles in this dot formation operation. The printers also perform a carrying operation of carrying the paper in an intersecting direction that intersects the movement direction of the nozzles (hereinafter referred to as the "carrying direction"). When the printer repeatedly performs the dot formation operation and the carrying operation, a plurality of raster lines that are parallel in the carrying direction are printed on the medium. A print-control apparatus, for example, controls this printing operation. A computer on which a printer driver is installed corresponds to such a print-control apparatus.

With this type of printer, the ejection characteristics of the ink droplets, such as the ink droplet amount and its travel direction, vary for each nozzle. This variation in ejection properties is undesirable because it can cause darkness non-uniformities in the printed image. Accordingly, in conventional printers, a correction value is set for each nozzle, and the amount of ink is set based on those correction values that have been set (for example, see JP 2-54676A). That is, output property coefficients that indicate the properties of the ink ejection amount for each nozzle are stored in a head property register. Those output property coefficients are then used when ink droplets are ejected in order to prevent darkness non-uniformities in the printed image.

Such a printer corrects the ejection amount for each nozzle but does not take into consideration darkness non-uniformities that are caused by bending in the path of travel of the ink droplets and darkness non-uniformities that are caused by carrying discrepancies of the medium. Such darkness non-uniformities occur due to the pitch between adjacent raster lines being smaller or larger than a specific pitch, and with conventional printers cannot be fixed easily. This is because such darkness non-uniformities occur due to the combination of the nozzles that are responsible for adjacent raster lines.

SUMMARY OF THE INVENTION

The present invention was arrived at in light of these issues, and it is an object thereof to improve the quality of a printed image while minimizing the amount of memory that is used.

A main aspect of the invention for achieving the foregoing object is the following print-control method.

A print-control method includes:

a first print-control step of repeatedly performing a unit image formation operation of forming a unit image in a unit area on a medium by ejecting ink from a plurality of nozzles that are arranged in a predetermined direction and that are moved in a movement direction, and a first carrying operation of carrying the medium by a predetermined carry amount, so as to print an image in an end portion, in a carrying direction in which the medium is carried, of the medium; and a second print-control step of repeatedly performing the unit image formation operation and a second carrying operation of carrying the medium by an other predetermined carry amount, so as to print an image in an intermediate portion, in the carrying direction, of the medium;

wherein darkness of each of the unit images within a mixed range, in which unit images that are printed in the first print-control step and unit images that are printed in the second print-control step are mixed, is corrected based on a correction value that is used in the second print-control step.

Features and objects of the present invention other than the above will be made clear by reading the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings.

FIG. 17 is a conceptual diagram of a record table that is provided in the memory of the computer.

FIG. 18 is a conceptual diagram of a correction value storage section that is provided in the memory of the printer.

DETAILED DESCRIPTION OF PREFERRED EMBODIMENTS

Figure 1:
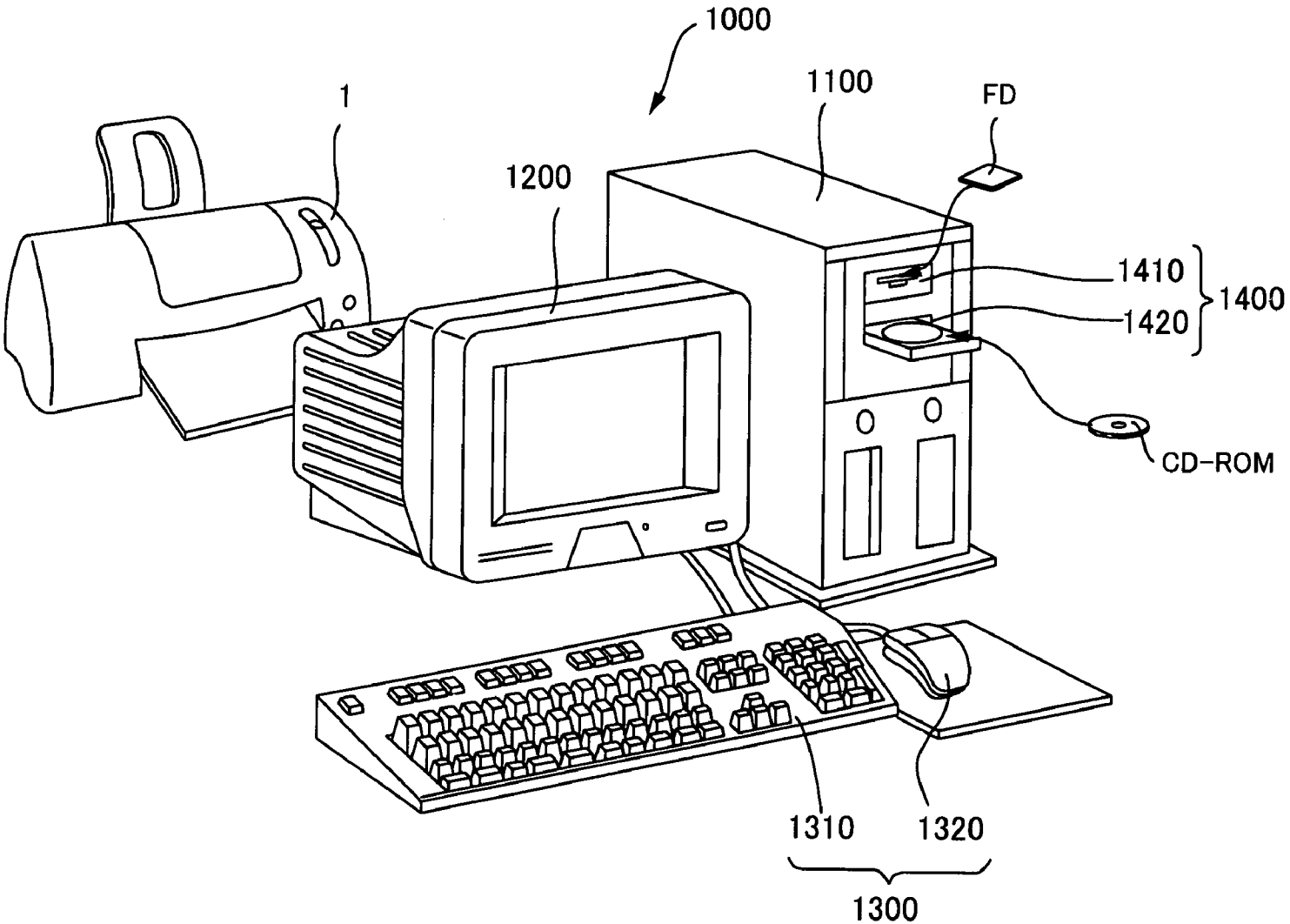
FIG. 1 is a diagram that shows an external configuration of a printing system.

At least the following matters will be made clear by the description in the present specification and the description of the accompanying drawings.

It is possible to achieve the following print-control method.

A print-control method includes:

a first print-control step of repeatedly performing a unit image formation operation of forming a unit image in a unit area on a medium by ejecting ink from a plurality of nozzles that are arranged in a predetermined direction and that are moved in a movement direction, and a first carrying operation of carrying the medium by a predetermined carry amount, so as to print an image in an end portion, in a carrying direction in which the medium is carried, of the medium; and a second print-control step of repeatedly performing the unit image formation operation and a second carrying operation of carrying the medium by an other predetermined carry amount, so as to print an image in an intermediate portion, in the carrying direction, of the medium;

wherein darkness of each of the unit images within a mixed range, in which unit images that are printed in the first print-control step and unit images that are printed in the second print-control step are mixed, is corrected based on a correction value that is used in the second print-control step.

With this print-control method, the darkness of the unit images is corrected based on correction values, and thus the quality of the printed image can be improved. Also, because the darkness of each of the unit images in the mixed range is corrected based on the correction value(s) used in the second print-control step, it is possible to reduce the amount of memory that is required to store the correction values.

It is preferable that in the second print-control step, a predetermined number of the correction values are stored in a correction value storage section, and the correction values are repeatedly used based on a combination of the nozzles and the unit areas, to perform the darkness correction.

With this print-control method, the amount of memory that is required to store the correction value(s) used in the second print-control step can be reduced.

It is preferable that the darkness of each of the unit images within the mixed range is corrected using the correction value used in the second print-control step as is.

With this print-control method, the correction value(s) used in the second print-control step can be used as is, and thus the amount of memory that is required can be reduced.

It is preferable that the darkness of each of the unit images within the mixed range is corrected using an amended correction value obtained by amending the correction value that is used in the second print-control step.

With this print-control method, darkness correction using correction values that correspond to the degree of influence of the second print-control step becomes possible, and this allows suitable correction to be performed. Further, the amended correction values are obtained by amending the correction values that are used in the second print-control step, and thus the amount of required memory can be reduced compared to a case where the amended correction values are determined separately.

It is preferable that the amended correction value is obtained by multiplying the correction value used in the second print-control step by an amendment coefficient.

With this print-control method, it is only necessary for the memory to store the correction values that are used in the second print-control step and the amendment coefficients, and thus the amount of required memory can be reduced.

It is preferable that the amendment coefficient is determined such that a degree of darkness correction becomes smaller as proximity to the end portion, in the carrying direction, of the medium increases.

With this print-control method, the mixed range can be suitably corrected, and this allows the quality of the printed image to be improved.

It is preferable that darkness of each of the unit images that are printed in the first print-control step is corrected based on the correction value used in the second print-control step.

With this print-control method, the darkness of the unit images that are printed in the first print-control step is corrected based on the correction values that are used in the second print-control step, and thus the amount of required memory can be reduced.

It is preferable that the other predetermined carry amount is greater than the predetermined carry amount.

With this print-control method, the printing speed for the intermediate portion of the medium can be increased.

It will become clear that it is also possible to achieve the following print-control method.

A print-control method includes:

a first print-control step of repeatedly performing a unit image formation operation of forming a unit image in a unit area on a medium by ejecting ink from a plurality of nozzles that are arranged in a predetermined direction and that are moved in a movement direction, and a first carrying operation of carrying the medium by a predetermined carry amount, so as to print an image in an end portion, in a carrying direction in which the medium is carried, of the medium; and a second print-control step of performing darkness correction by repeatedly using, based on a combination of the nozzles and the unit areas, a predetermined number of correction values that are stored in a correction value storage section, and repeatedly performing the unit image formation operation and a second carrying operation of carrying the medium by an other predetermined carry amount that is greater than the predetermined carry amount, so as to print an image in an intermediate portion, in the carrying direction, of the medium;

wherein darkness of each of the unit images that are printed in the first print-control step is corrected based on the correction values used in the second print-control step; and wherein darkness of each of the unit images within a mixed range, in which unit images that are printed in the first print-control step and unit images that are printed in the second print-control step are mixed, is corrected using either the correction values that are used in the second print-control step as they are, or amended correction values that are each obtained by multiplying each of the correction values used in the second print-control step by an amendment coefficient that is determined such that a degree of darkness correction becomes smaller as proximity to the end portion, in the carrying direction, of the medium increases.

With this print-control method, substantially all of the effects mentioned above are attained, and thus the object of the invention is most effectively achieved.

It will become clear that it is also possible to achieve the following printing system.

A printing system is provided with:

a plurality of nozzles that are arranged in a predetermined direction and that are moved in a movement direction;

a medium carrying section that carries a medium in a carrying direction that intersects the movement direction;

a correction value storage section that stores correction values for correcting darkness of each of unit images that are formed in respective unit areas, the unit areas each being oriented in the movement direction and being adjacent to one another in the carrying direction; and a controller that performs a first print-control step of repeatedly performing a unit image formation operation of forming the unit images by ejecting ink from the nozzles, and a first carrying operation of carrying the medium by a predetermined carry amount, so as to print an image in an end portion, in the carrying direction, of the medium, and a second print-control step of repeatedly performing the unit image formation operation and a second carrying operation of carrying the medium by an other predetermined carry amount, so as to print an image in an intermediate portion, in the carrying direction, of the medium, and that corrects darkness of each of the unit images within a mixed range, in which unit images that are printed in the first print-control step and unit images that are printed in the second print-control step are mixed in the carrying direction, based on the correction value that is used in the second print-control step.

It will become clear that it is also possible to achieve the following print-control apparatus.

A print-control apparatus, which is for controlling a printing apparatus that is provided with a plurality of nozzles that are arranged in a predetermined direction and that are moved in a movement direction and a medium carrying section that carries a medium in a carrying direction that intersects the movement direction, performs a first print-control step of causing the printing apparatus to repeatedly perform a unit image formation operation of forming the unit images by ejecting ink from the nozzles, and a first carrying operation of carrying the medium by a predetermined carry amount, so as to print an image in an end portion, in the carrying direction, of the medium, and a second print-control step of causing the printing apparatus to repeatedly perform the unit image formation operation and a second carrying operation of carrying the medium by an other predetermined carry amount, so as to print an image in an intermediate portion, in the carrying direction, of the medium, and corrects darkness of each of the unit images within a mixed range, in which unit images that are printed in the first print-control step and unit images that are printed in the second print-control step are mixed in the carrying direction, based on a correction value that is used in the second print-control step.

First Embodiment

<Overall Configuration of Printing System 1000>

FIG. 1 is an explanatory drawing showing an external structure of a printing system 1000. An embodiment of the printing system 1000 is described below. Here, the printing system 1000 is a system that includes at least a printing apparatus and a print-control apparatus. The printing system 1000 of this embodiment includes a printer 1 that serves as a printing apparatus and a computer 1100 that serves as a print-control apparatus. Specifically, the printing system 1000 includes a printer 1, a computer 1100, a display device 1200, an input device 1300, and a record/play device 1400.

The printer 1 prints an image on media such as paper, cloth, or film. It should be noted that the medium in the following description is a paper S, which is a representative medium (see FIG. 9). The computer 1100 is communicably connected to the printer 1. The computer 1100 outputs print data that correspond to an image to the printer 1 so that the printer 1 can print that image. The display device 1200 has a display. The display device 1200 displays, for example, the user interface of an application program 1120 or a printer driver 1130 (see FIG. 3). The input device 1300 is for example a keyboard 1310 or a mouse 1320. The record/play device 1400 is for example a flexible disk drive device 1410 or a CD-ROM drive device 1420. A printer driver 1130 is installed on the computer 1100. The printer driver 1130 is one type of computer program, and is for achieving the function of converting image data that have been output from the application program 1120 into print data.

The printer driver 1130 is composed of codes for achieving various functions. It should be noted that the printer driver 1130 is provided stored on a storage medium (computer readable storage medium) such as a flexible disk FD or a CD-ROM. The printer driver 1130 can also be downloaded onto the computer 1100 via the Internet.

===Computer===

<Configuration of Computer 1100>

Figure 2:
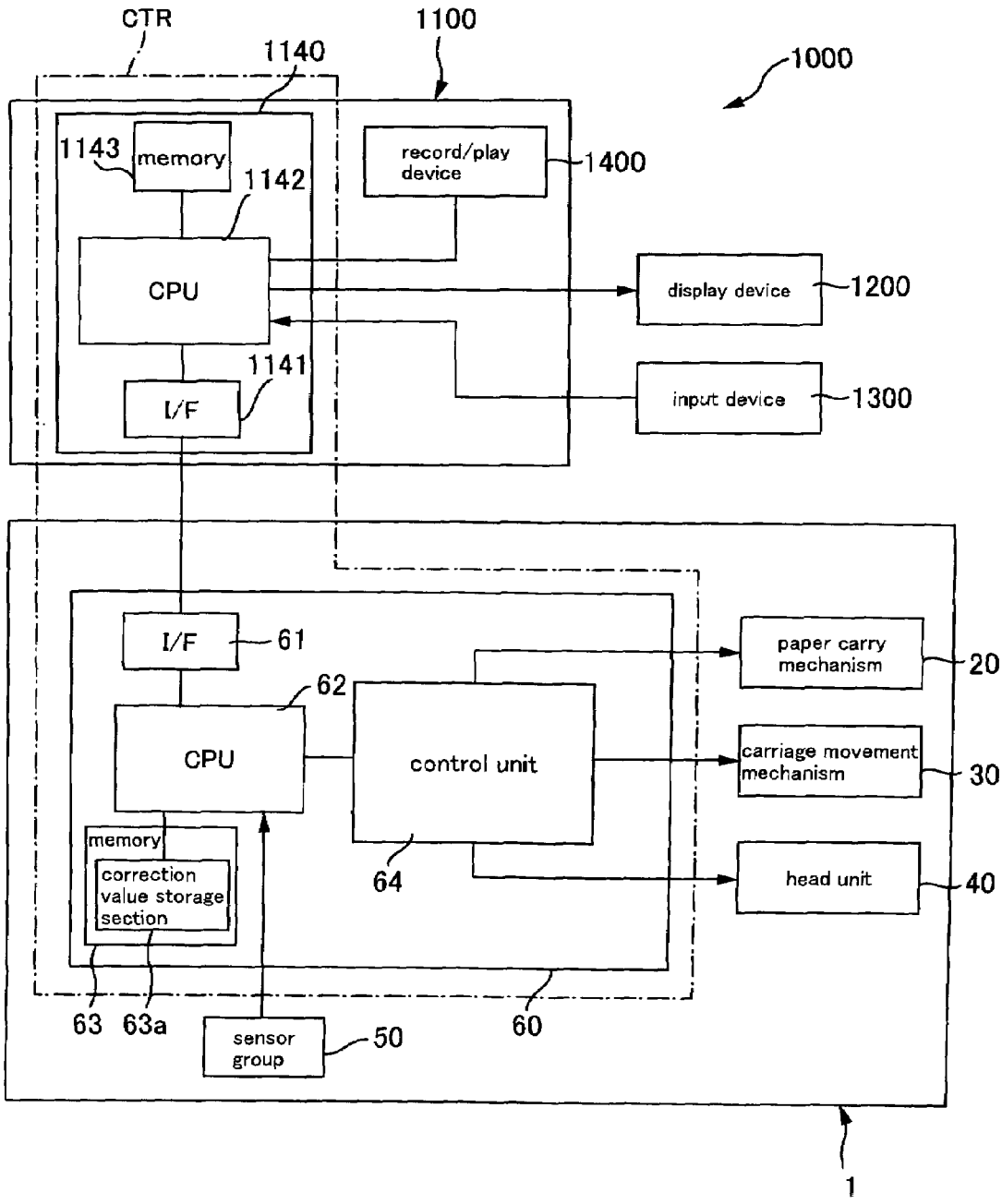
FIG. 2 is a block diagram for describing a configuration of a computer and a printer.

FIG. 2 is a block diagram for describing a configuration of the computer 1100 and the printer 1. The configuration of the computer 1100 will be described first. It should be noted that structural elements that have already been described are assigned the same reference numerals as before and thus will not be described again.

The computer 1100 has the record/play device 1400 mentioned above and a host-side controller 1140. The record/play device 1400 is communicably connected to the host-side controller 1140, and for example is mounted to the housing of the computer 1100. The host-side controller 1140 is for performing the controls of the computer 1100, and is communicably connected to the display device 1200 and the input device 1300 as well. In this embodiment, the host-side controller 1140 and a printer-side controller 60 together make up a controller CTR. The host-side controller 1140 has an interface section 1141, a CPU 1142, and a memory 1143. The interface section 1141 is between the host-side controller 1140 and the printer 1 and is for sending and receiving data between the two. The CPU 1142 is a computation processing device for performing the overall control of the computer 1100. The memory 1143 is for securing a working area and an area for storing the computer programs for the CPU 1142, for example, and is constituted by a memory element such as a RAM, EEPROM, or a ROM. Examples of the computer programs stored on the memory 1143 include the application program 1120 and the printer driver 1130 (see FIG. 3). The CPU 1142 is for performing various controls in accordance with the computer programs stored on the memory 1143.

<Regarding the Computer Programs>

Figure 3:
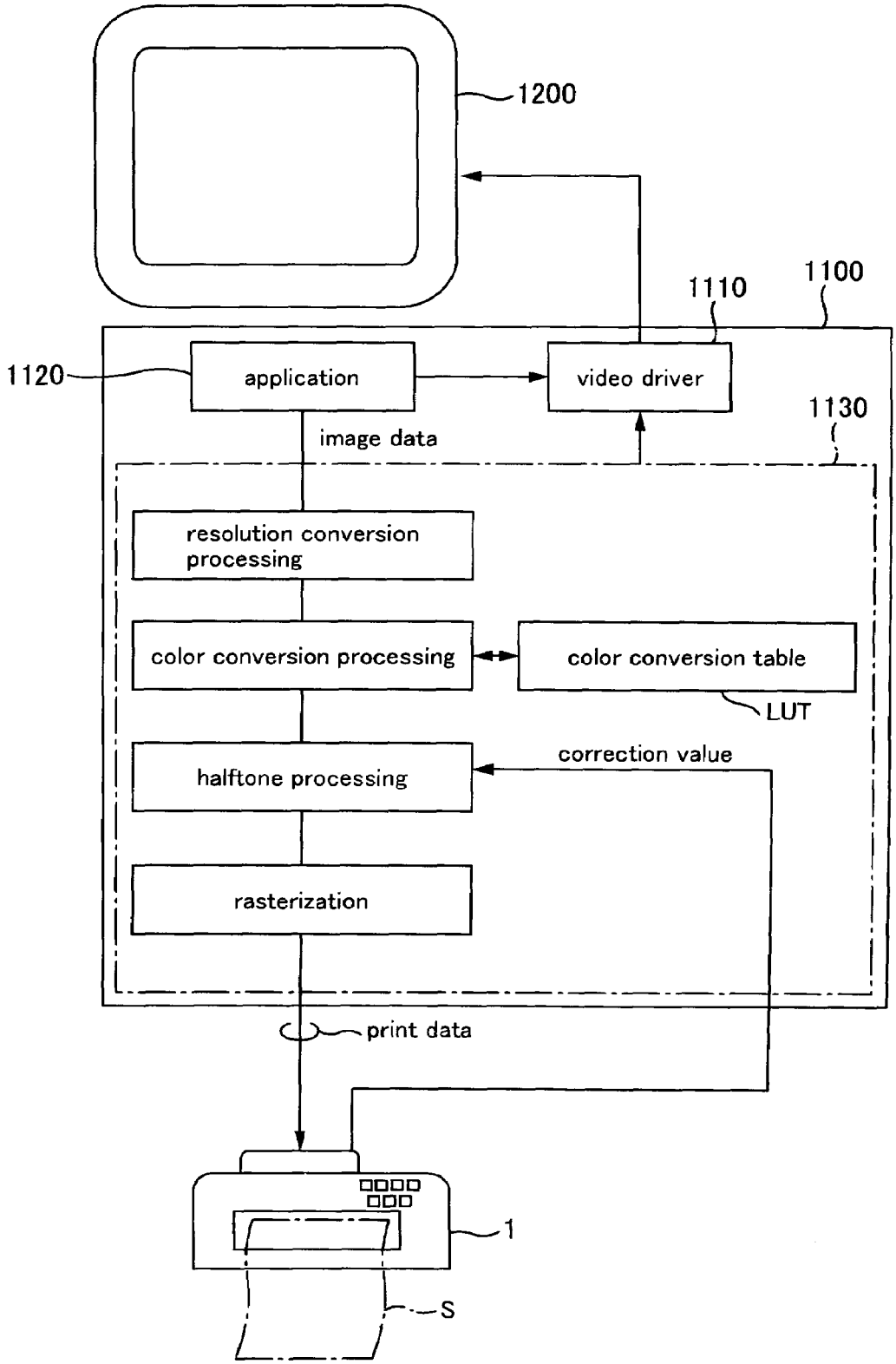
FIG. 3 is an explanatory diagram for schematically illustrating a computer program that is stored in a memory of the computer.

FIG. 3 is an explanatory diagram that schematically shows a computer program stored on the memory 1143 of the computer 1100. The host-side controller 1140 runs computer programs such as the video driver 1110, the application program 1120, and the printer driver 1130 on an operating system. It should be noted that for the sake of convenience, in the following description the processing of the host-side controller 1140 that is performed according to the computer programs is described as the processing of those computer programs. For example, the processing of the host-side controller 1140 that is performed due to the application program 1120 or the printer driver 1130, both of which are types of computer programs, is described as the processing of the application program 1120 or the processing of the printer driver 1130.

The video driver 1110 has the function of displaying a user interface, for example, on the display device 1200 in accordance with a display command from the application program 1120 or the printer driver 1130.

The application program 1120 has the function of performing image editing, for example, and creates image data. The user can give a command to print an image that has been edited by the application program 1120 through the user interface of the application program 1120. Upon receiving this print command, the application program 1120 outputs the image data to the printer driver 1130. When the user issues a print command through the user interface of the application program 1120, the printer driver 1130 receives the image data from the application program 1120. The printer driver 1130 then converts the image data into print data and outputs those print data to the printer 1.

The image data include pixel data as the data regarding the pixels of the image to be printed. The gradation values, etc., of the pixel data are converted in accordance with process stages that are described later. Then, in the final print-data stage, the pixel data are converted into data regarding the dots to be formed on the paper (data about, for example, the color and size of the dots). Here, the pixels are virtually determined square grids on the paper for defining the positions onto which ink is to land and where dots are to be formed. A plurality of pixels lined up in the carriage movement direction (movement direction of the nozzles) collectively form a unit area UA (for exmaple, see FIG. 13B) that is oriented in the carriage movement direction. The unit areas UA are adjacent to one another in the carrying direction, which intersects the carriage movement direction. Thus, an image can be said to be made of a plurality of unit images formed in each unit area (these correspond to the raster lines R discussed later; see FIG. 13B).

The print data are data in a format that can be understood by the printer 1, and include pixel data and various command data. The command data are data for ordering the printer 1 to execute specific operations. The command data include data such as data for ordering paper supply, data that indicate a carry amount, and data for ordering discharge of the paper. In order to convert the image data that are output from the application program 1120 into print data, the printer driver 1130 carries out such processes as resolution conversion, color conversion, halftone processing, and rasterization. The processing that is performed by the printer driver 1130 is described below.

<Processing Performed by the Printer Driver 1130>

Resolution conversion is processing for converting the image data output from the application program 1120 to the resolution (the spacing between the dots when printing; also called the print resolution) that is used when printing the image on the paper S. For example, if the print resolution has been set to 720×720 dpi, then the image data that are received from the application program 1120 are converted into image data whose resolution is 720×720 dpi. This conversion can be achieved by for example interpolating or decimating the pixel data. It should be noted that each piece of pixel data in the image data has a gradation value of one of multiple grades (for example, 256 grades) expressed in RGB color space. Hereinafter, pixel data having RGB gradation values will be referred to as RGB pixel data, and image data made of RGB pixel data will be referred to as RGB image data.

Color conversion is processing for converting the RGB pixel data of the RGB image data into data having gradation values of multiple grades (for example, 256 grades) expressed in CMYK color space. CMYK stands for the colors that are expressed by ink. That is, C stands for cyan, while M stands for magenta, Y for yellow, and K for black. Hereinafter, the pixel data having CMYK gradation values are referred to as CMYK pixel data, and the image data composed of this CMYK pixel data are referred to as CMYK image data. Color conversion is performed by referencing a table (color conversion lookup table LUT) that associates RGB gradation values with CMYK gradation values.

Halftone processing is processing for converting CMYK pixel data having gradation values of many grades into CMYK pixel data having gradation values of fewer grades that can be expressed by the printer 1. For example, through halftone processing, CMYK pixel data representing 256 gradation values are converted into 2-bit CMYK pixel data representing four gradation values. The 2-bit CMYK pixel data are data that, for each color, indicate "no dot ejection (no dot)" (binary data "00"), "formation of a small dot" (binary data "01"), "formation of a medium dot" (binary data "10"), and "formation of a large dot" (binary data "11"). Dithering, which is discussed later, is used for this halftone processing to create CMYK pixel data with which the printer 1 can form dots in a dispersed manner. During this halftone processing, the printer 1 performs darkness correction based on the correction values (discussed later). It should be noted that halftone processing can also be executed through γ-correction or error diffusion.

Rasterizing is processing for changing the CMYK image data that have been subjected to halftone processing into the data order in which they are to be transferred to the printer 1. The rasterized data are output to the printer 1 as the print data discussed above.

<Halftone Processing Through Dithering>

Figure 4:
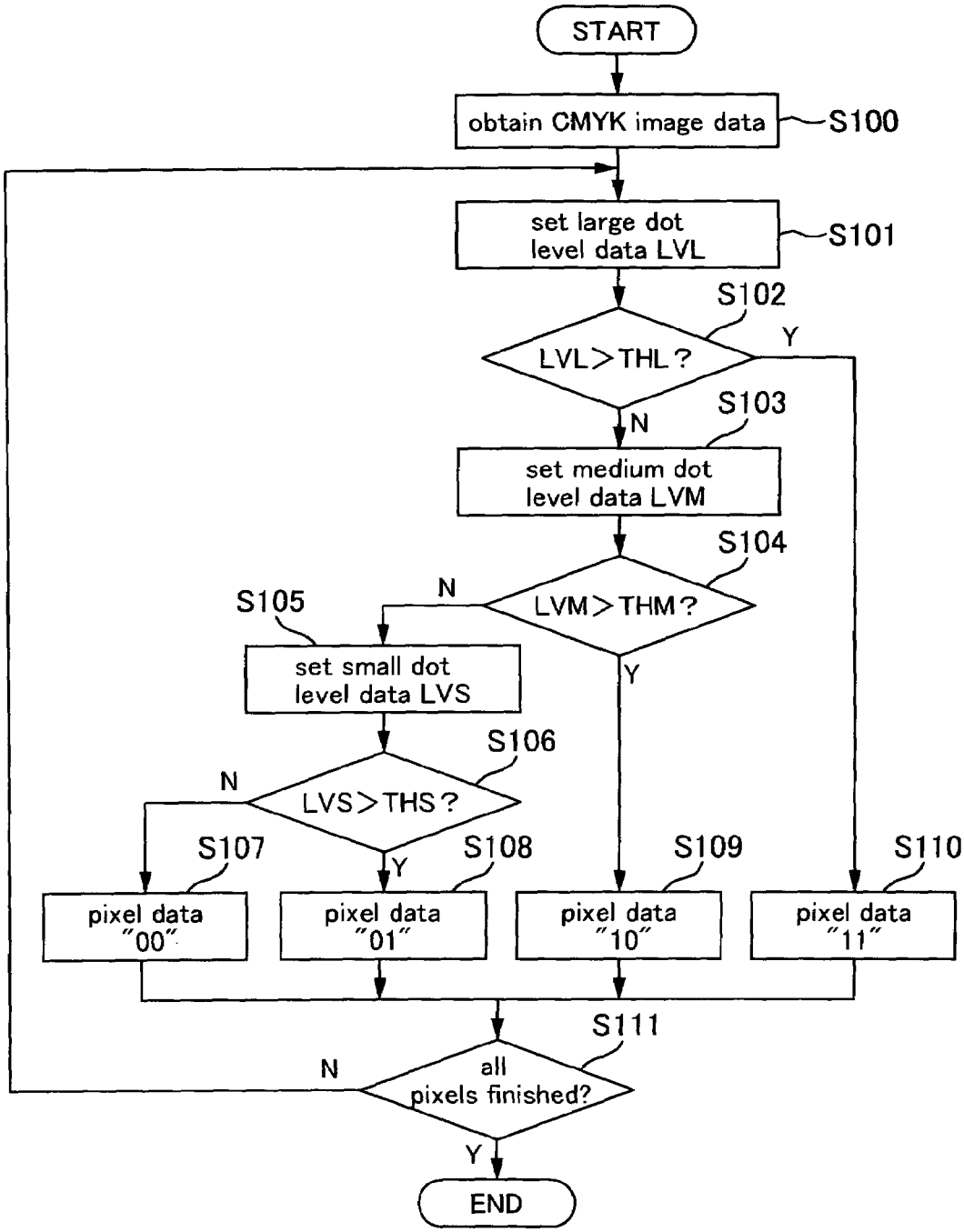
FIG. 4 is a flowchart for describing halftone processing achieved by dithering.

Halftone processing through dithering in described in detail below. FIG. 4 is a flowchart for describing halftone processing through dithering. The printer driver 1130 executes the following steps in accordance with this flowchart.

First, in step S100, the printer driver 1130 obtains CMYK image data. The CMYK image data are for example made of image data expressed by gradation values of 256 gradations for each of cyan, magenta, yellow, and black. That is, the CMYK image data include cyan image data for cyan (C), magenta image data for magenta (M), yellow image data for yellow (Y), and black image data for black (K). The cyan, magenta, yellow, and black image data are made of cyan, magenta, yellow, and black pixel data, respectively, that indicate the gradation value for each pixel. It should be noted that the following description is made with respect to the black image data as representative of the cyan, magenta, yellow, and black image data.

The printer driver 1130 executes the processing of steps S101 to S111 on all of the black pixel data of the black image data, sequentially changing the black pixel data to be processed. Through this processing, the black image data are converted into 2-bit data that indicate one of four gradation values for each black pixel data.

Figure 5:
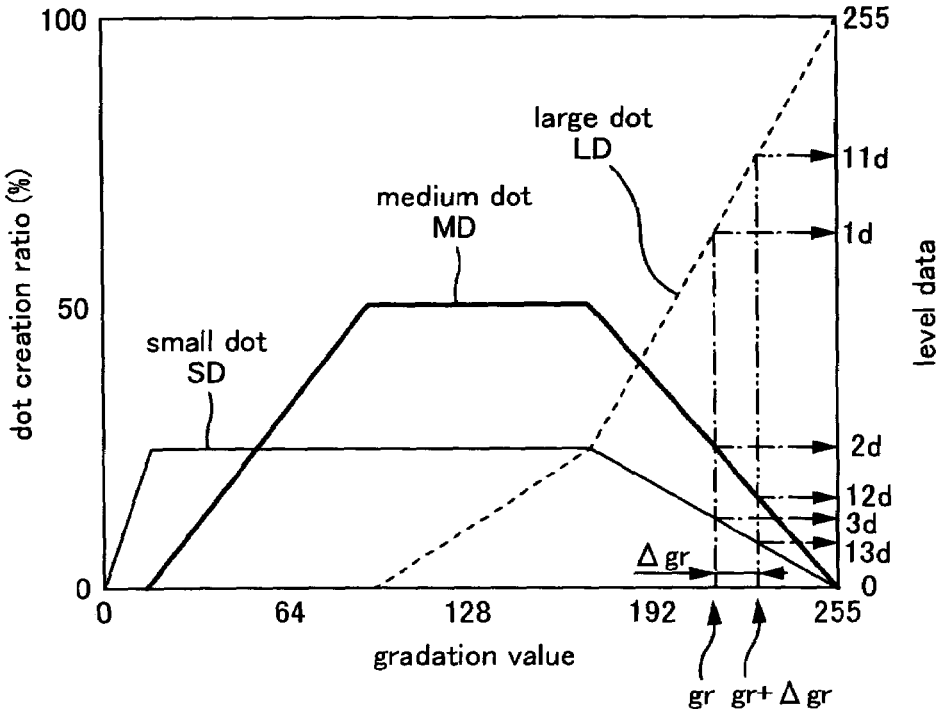
FIG. 5 is a diagram showing a creation ratio table that is used to set the level data for the large, medium, and small dots.

As regards this conversion, first in step S101 the level data LVL for large dots are set based on the gradation value of the black pixel data to be processed. This setting is made using a creation ratio table, for example. Here, FIG. 5 is a diagram that shows the creation ratio table that is used to set the level data for large, medium, and small dots. In this diagram, the horizontal axis indicates gradation values (0-255), the vertical axis on the left indicates the dot creation ratio (%), and the vertical axis on the right indicates the level data. The level data are data in which the creation ratio of the dot has been converted to one of 256 gradations having a value from 0 to 255. Here, the "dot creation ratio" means the ratio of pixels in which dots are formed to the number of pixels in a predetermined uniform area expressed uniformly at a constant gradation value. Let us assume a case where the dot creation ratio at a certain gradation value is large dot 65%, medium dot 25%, and small dot 10%, and with this dot creation ratio, an area of 100 pixels made of 10 pixels in the vertical direction by 10 pixels in the horizontal direction is printed. In this case, of those 100 pixels, 65 pixels will be formed by large dots, 25 pixels will be formed by medium dots, and 10 pixels will be formed by small dots. The profile SD indicated by the thin solid line in FIG. 5 shows the creation ratio for small dots. The profile MD indicated by the thick solid line in FIG. 5 shows the creation ratio for medium dots, and the profile LD indicated by the broken line shows the creation ratio for large dots.

Next, in step S101, the level data LVL corresponding to the gradation value is read from the large dot profile LD. For example, as shown in FIG. 5, if the gradation value of the black pixel data to be processed is gr, then level data LVL of 1 d is obtained from the point of intersection with the profile LD. In practice, the profile LD is stored on the memory 1143 of the computer 1100 in the form of a one-dimensional table, for example. The printer driver 1130 then reads the level data LVL by referencing this table.

Figure 6:
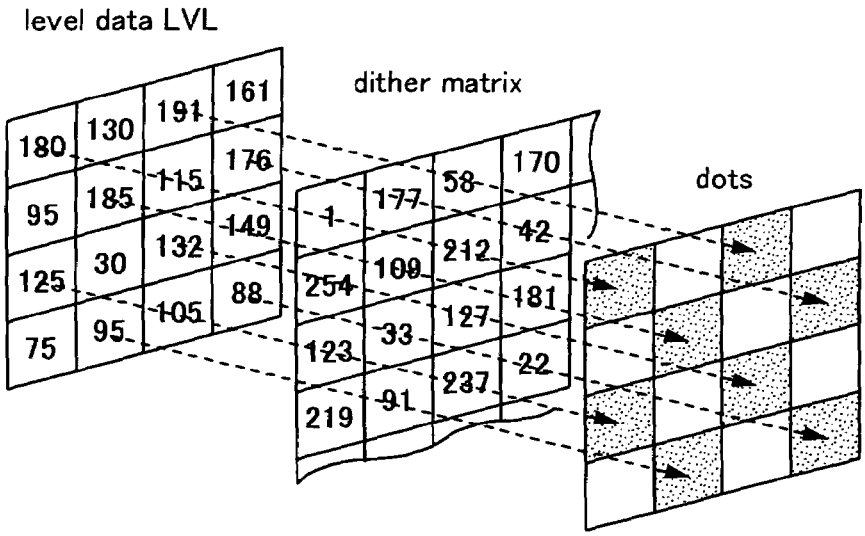
FIG. 6 is a diagram that schematically shows an example of determining ON/OFF of a dot through dithering.

In step S102, it is determined whether or not the level data LVL that have been read out in this manner is larger than a threshold value THL. Here, a decision regarding whether the dot is on or off is made through dithering. A different threshold value THL is set for each pixel block of a so-called dither matrix. The dither matrix that is used in this embodiment expresses a value from 0 to 254 for 16×16 square pixel blocks. FIG. 6 is a diagram that schematically shows an example of the decision regarding whether a dot is on or off through dithering. In this example, the printer driver 1130 first compares the level LVL of the black pixel data with the threshold value THL of the pixel block on the dither matrix corresponding to that black pixel data. If the level data LVL is higher than the threshold value THL, then it is determined that the dot is to be turned on (that is, a dot is to be formed). On the other hand, if the level data LVL is equal to or less than the threshold value THL, then it is determined that the dot is to be turned off (that is, a dot is not formed). In FIG. 6, the pixel data in the shaded areas of the dot matrix are black pixel data in which the dot is turned on. That is, in step S102, the printer driver 1130 advances to step S110 if the level data LVL is larger than the threshold value THL, and advances to step S103 in all other cases.

Here, if the printer driver 1130 has advanced the procedure to step S10, then it records the value "11" in association with that black pixel data being processed to designate it as pixel data (2-bit data) that indicate a large dot, and advances the procedure to step S111. Then, in step S111, the printer driver 1130 determines whether or not the processing has ended for all black pixel data, and if the processing has ended, then the printer driver 1130 ends halftone processing. On the other hand, if the processing has not ended, then the printer driver 1130 switches to another piece of black pixel data that has not yet been processed and returns the procedure to step S101.

On the other hand, if the procedure has been advanced to step S103, then the printer driver 1130 sets the medium dot level data LVM. The level data LVM for medium dots are set through the creation ratio table described above, based on the gradation value. The method for setting the medium dot level data LVM is the same as the method for setting the large dot level data LVL. For example, in the example of FIG. 5, the level data LVM corresponding to the gradation value gr is found as 2 d, which is shown by the point of intersection with the profile MD indicating the creation ratio for medium dots. Once the level data LVM has been set in this way, the procedure is advanced to step S104. In step S104, the medium dot level data LVM is compared in largeness with the threshold value THM to determine whether a medium dot is to be turned on or off. The method by which dots are determined to be either on or off is the same as that for large dots.

In this embodiment, the determination of whether a medium dot is to be turned on or off is performed using a different threshold value THM from the threshold value THL for the case of a large dot. This is because if the on/off determination is made using the same dither matrix for medium dots and large dots, then there is the possibility that pixels whose dots are likely to be off for large and medium dots will match and thus cause a lower creation ratio for medium dots than the desired creation ratio. In order to circumvent this problem, different dither matrices for large dots and medium dots are adopted in the present embodiment. As a result, both dots can be formed appropriately.

Figures 7A, 7B, 8:
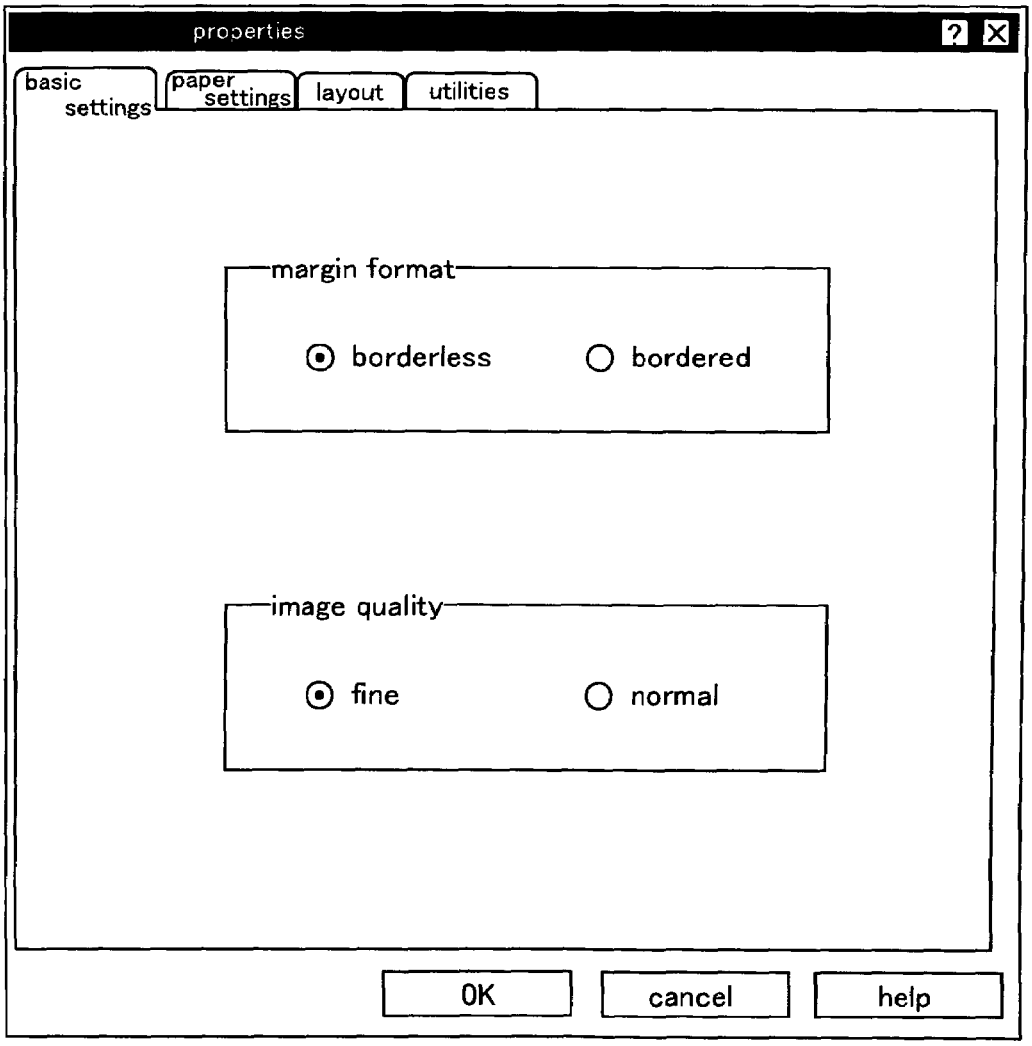
FIG. 7A is a diagram showing a dither matrix used for determination of large dots.
FIG. 7B is a diagram showing a dither matrix used for determination of medium dots.
FIG. 8 is an explanatory diagram of a user interface of a printer driver.

FIG. 7A is a diagram showing the dither matrix that is used for the determination of large dots. FIG. 7B is a diagram showing the dither matrix that is used for the determination of medium dots. In this embodiment, the first dither matrix TM of FIG. 7A is used for large dots, and the second dither matrix UM of FIG. 7B is used for medium dots. The second dither matrix UM is obtained by symmetrically moving the threshold values in first dither matrix TM about the center in the carrying direction (in the drawings, the vertical direction). It should be noted that, as discussed above, a 16×16 matrix is used in this embodiment, but for the sake of simplifying the drawings, a 4×4 matrix is shown in FIGS. 7A and 7B. It is also possible to use completely different dither matrices for large and medium dots.

In step S104, if the medium dot level data LVM is larger than the medium dot threshold value THM, then the printer driver 1130 determines that a medium dot should be turned on and advances the procedure to step S109; in other cases, the printer driver 1130 advances the procedure to step S105. Here, if the procedure is advanced to step S109, then the printer driver 1130 records a value "10" in association with that black pixel data being processed to show that the pixel data indicates a medium dot, and advances the procedure to step S111. In step S111, the printer driver 1130 performs the same processing as that described above.

If the procedure has been advanced to step S105, then the printer driver 1130 sets the small dot level data LVS in the same way that it sets the level data for large dots and medium dots. It should be noted that the dither matrix for the small dots is preferably different from those for the medium dots and the large dots in order to prevent a drop in the creation ratio of small dots, as described above. In step S106, the printer driver 1130 compares the level data LVS with the small dot threshold value THS, and if the level data LVS is larger than the small dot threshold value THS, then it advances the procedure to step S108, and in other cases it advances the procedure to S107. Here, if the printer driver 1130 has advanced the procedure to step S108, then it records the value "01" in association with that black pixel data being processed to show that the pixel data indicates a small dot, and then advances the procedure to step S111. On the other hand, if it has advanced the procedure to step S107, then the printer driver 1130 records the value "00" in association with that black pixel data being processed to show that the pixel data indicates that no ink is to be ejected (no dot), and advances the procedure to step S111. In step S111, the printer driver 1130 performs the same processing as that described above.

<Regarding the Settings of the Printer Driver 1130>

FIG. 8 is an explanatory diagram of a user interface of the printer driver 1130. The user interface of the printer driver 1130 is displayed on the display device 1200 by the video driver 1110. The user can adjust the various settings of the printer driver 1130 using the input device 1300. The basic settings that are available include, for example, settings for the margin format mode and the image quality mode. The paper settings that are available include, for example, settings for the paper size mode. The printer driver 1130 recognizes the print resolution and the paper size, for example, based on the settings that are made through the user interface.

===Printer===

<Configuration of the Printer 1>

Figure 9:
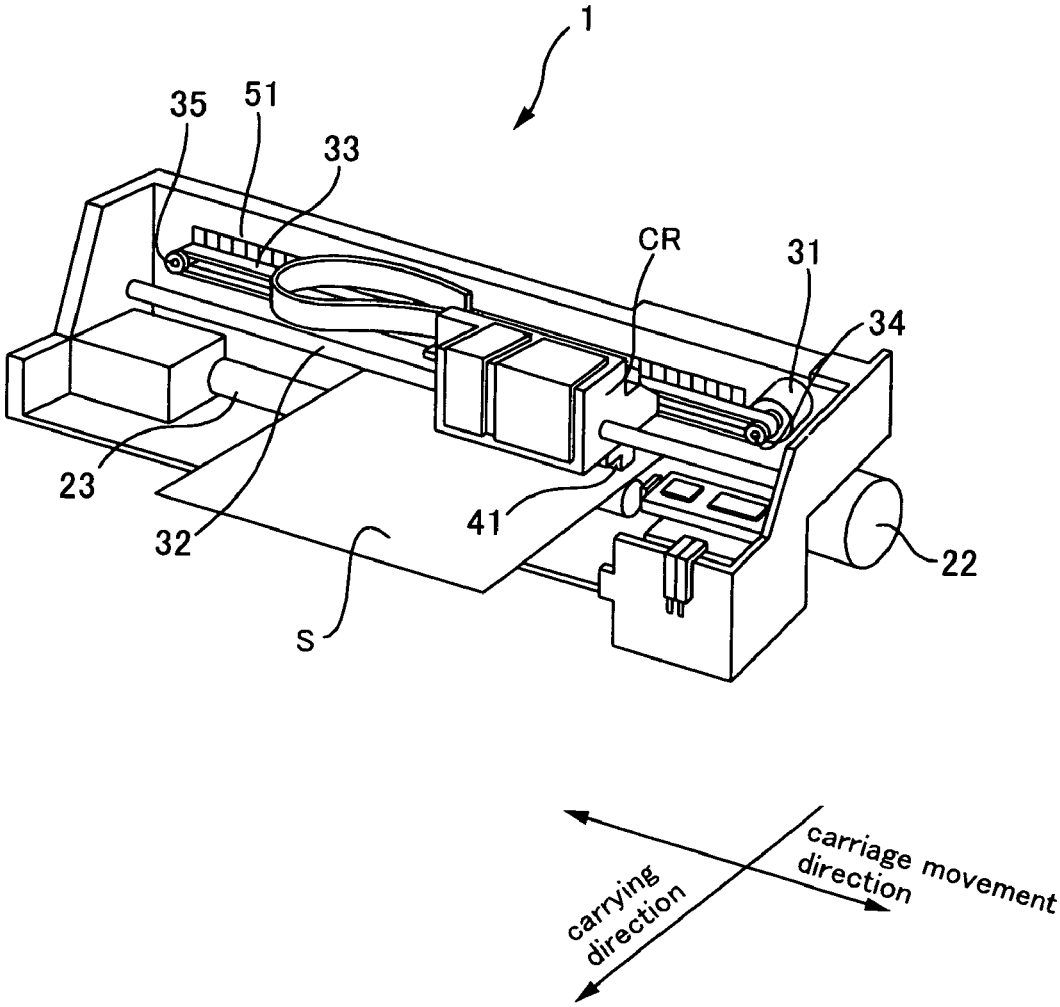
FIG. 9 is a diagram showing a configuration of the printer.
Figure 10:
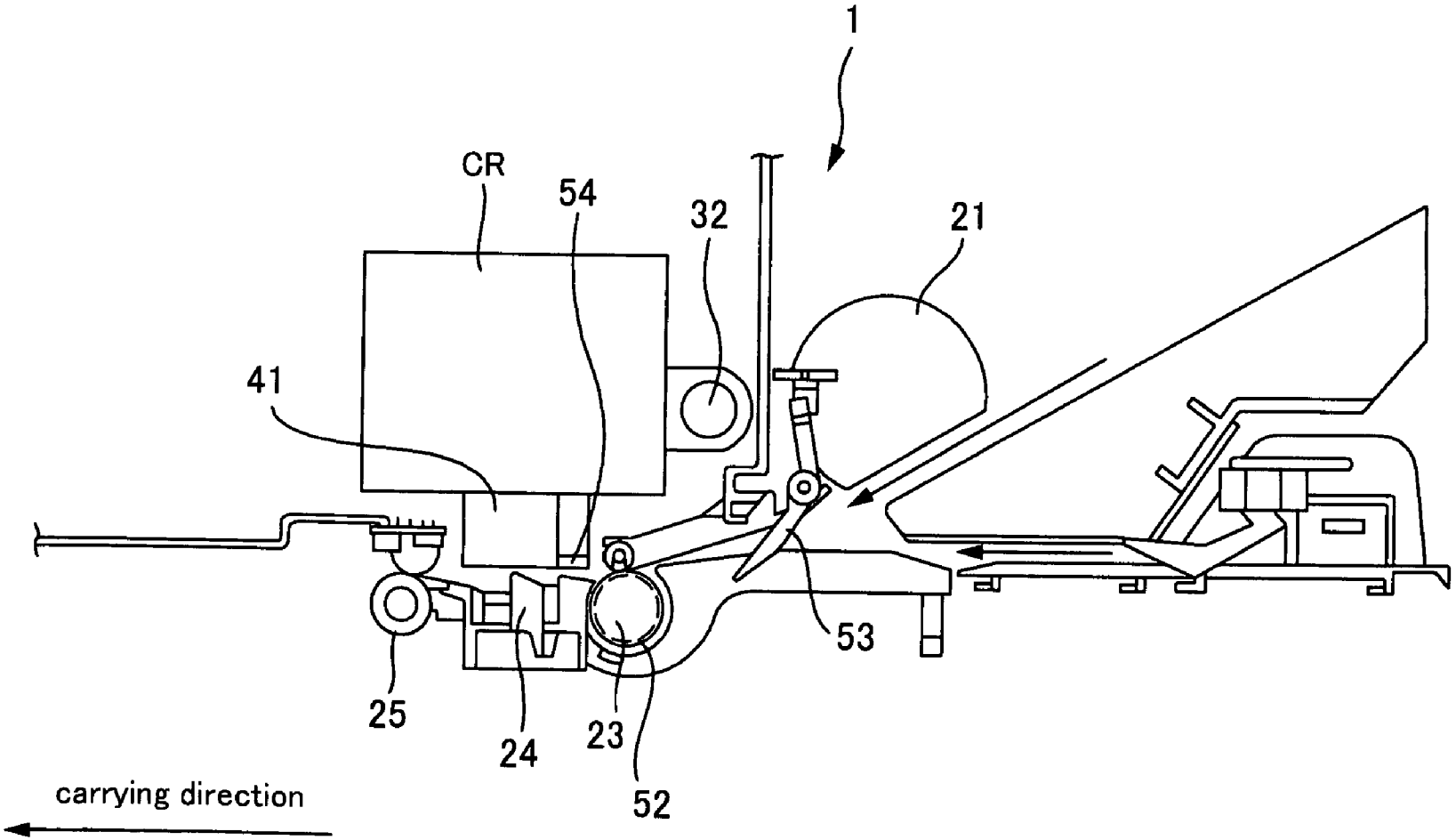
FIG. 10 is a vertical sectional view of an overall configuration of the printer.
Figure 11:
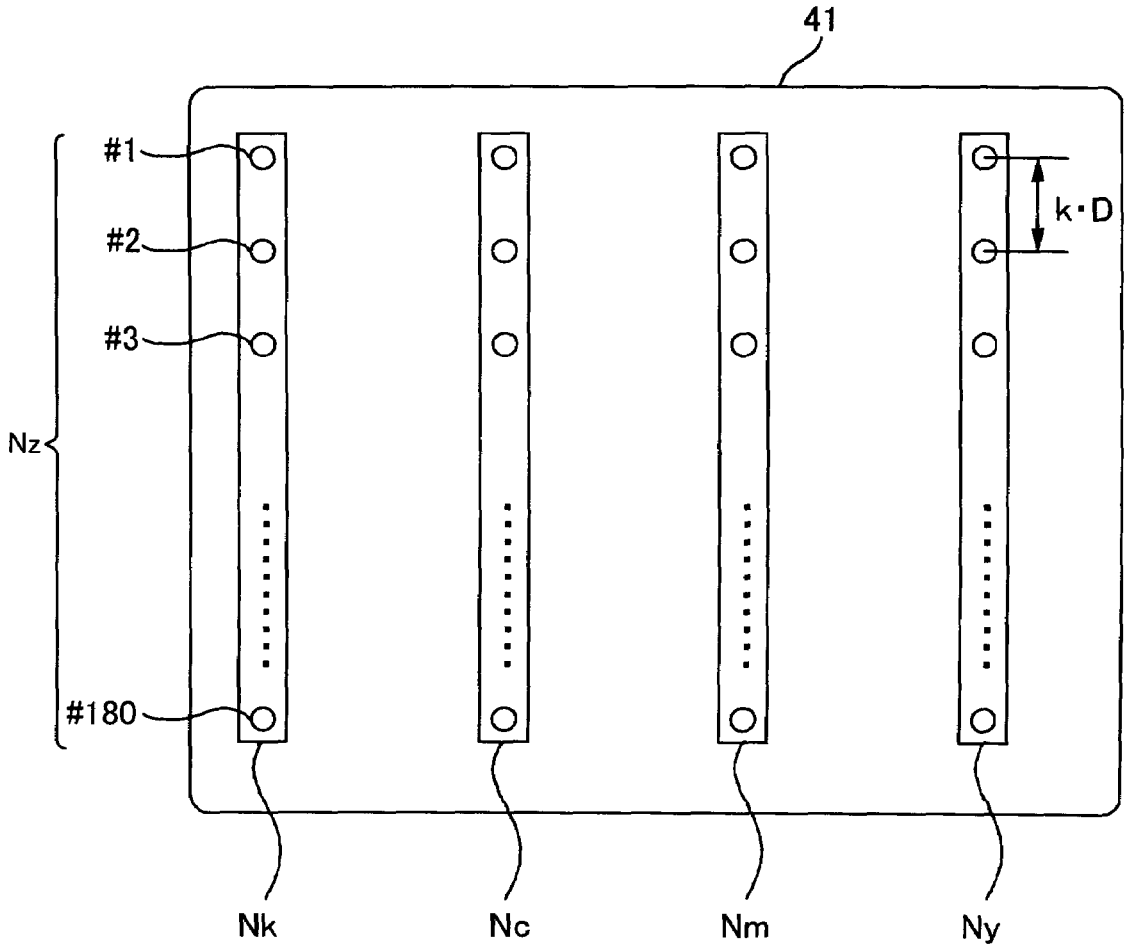
FIG. 11 is a diagram showing an arrangement of nozzles.
Figure 11:
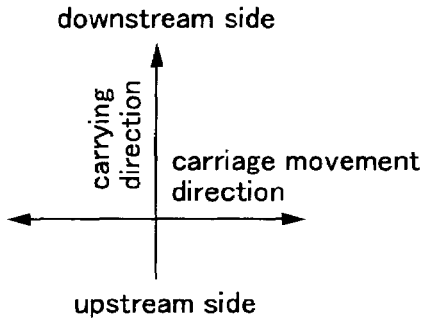

Next, the configuration of the printer 1 is described. Here, FIG. 9 is a diagram showing the configuration of the printer 1 of the embodiment. FIG. 10 is a vertical cross-section of the entire configuration of the printer 1 of the embodiment. FIG. 11 is a diagram showing the arrangement of the nozzles Nz in the lower surface of the head 41. It should be noted that the block diagram of FIG. 2 also is used in the following description.

As shown in FIG. 2, the printer 1 has a paper carry mechanism 20, a carriage movement mechanism 30, a head unit 40, a sensor group 50, and a printer-side controller 60. The printer 1 receives print signals from the computer 1100, which serves as the print-control apparatus, and through the printer-side controller 60 controls the control targets, that is, the paper carry mechanism 20, the carriage movement mechanism 30, and the head unit 40. At this time, the printer-side controller 60 causes an image to be printed on the paper S based on the print data that have been received from the computer 1100. The sensors of the sensor group 50 monitor the conditions within the printer 1, and output the result of this detection to the printer-side controller 60. The printer-side controller 60 receives the detection results from the sensors and controls the control target based on those detection results.

As shown in FIG. 9 and FIG. 10, the paper carry mechanism 20 corresponds to the medium carrying section that carries the medium. That is, the paper carry mechanism 20 feeds the paper S forward to a printable position and carries the paper S in the carrying direction by a predetermined carry amount. The carrying direction is a direction that intersects the carriage movement direction, which is described next. The paper carry mechanism 20 has a paper feed roller 21, a carry motor 22, a carry roller 23, a platen 24, and a paper discharge roller 25. The paper feed roller 21 is a roller for automatically sending, into the printer, paper S that has been inserted into a paper insert opening, and in this example has a D-shaped cross-sectional shape. The carry motor 22 is a motor for carrying the paper S in the carrying direction, and its operation is controlled by the printer-side controller 60. The carry roller 23 is a roller for carrying the paper S that has been delivered by the paper feed roller 21 up to a printable region. The operation of the carry roller 23 also is controlled by the carry motor 22. The platen 24 is a member that supports the paper S being printed from the bottom face of the paper S. The paper discharge roller 25 is a roller for carrying the paper S for which printing has finished.

The carriage movement mechanism 30 is a mechanism for moving the carriage CR, to which the head unit 40 is attached, in the carriage movement direction. The carriage movement direction includes the movement direction from one side to the other side and the movement direction from the other side to the one side. The head 41 of the head unit 40 is provided with nozzles Nz for ejecting ink. Thus, movement of the carriage CR means that the nozzles Nz also move in the carriage movement direction. Consequently, the carriage movement direction corresponds to the movement direction of the nozzles Nz, and the carriage movement mechanism 30 corresponds to a nozzle movement section for moving the nozzles Nz in the movement direction.

The carriage movement mechanism 30 includes a carriage motor 31, a guide shaft 32, a timing belt 33, a drive pulley 34, and a driven pulley 35. The carriage motor 31 corresponds to a drive source for moving the carriage CR. The operation of the carriage motor 31 is controlled by the printer-side controller 60. The drive pulley 34 is attached to the rotation shaft of the carriage motor 31. The drive pulley 34 is disposed at one end side in the carriage movement direction. The driven pulley 35 is disposed on the side opposite the drive pulley 34 at the other end side in the carriage movement direction. The timing belt 33 is connected to the carriage CR and also is wound around the drive pulley 34 and the driven pulley 35. The guide shaft 32 supports the carriage CR in a manner that permits movement. The guide shaft 32 is attached oriented in the carriage movement direction. Consequently, when the carriage motor 31 is operated, the carriage CR moves in the carriage movement direction along the guide shaft 32.

The head unit 40 is for ejecting ink onto the paper S. As shown in FIG. 11, the head 41 of the head unit 40 is provided with a plurality of nozzles Nz for ejecting ink. The nozzles Nz are grouped according to the type of ink ejected, with each group constituting a nozzle row. The head 41 illustratively shown in the drawing has a black ink nozzle row Nk, a cyan ink nozzle row Nc, a magenta ink nozzle row Nm, and a yellow ink nozzle row Ny. Each nozzle row has n (n=180, for example) nozzles.

In the nozzle rows, the nozzles Nz are provided at a constant spacing (nozzle pitch: k•D) in a predetermined direction (in this example, the carrying direction). Here, D is the minimum dot pitch in the carrying direction, that is, it is the spacing at the maximum resolution of the dots formed on the paper S. Also, k is a coefficient that expresses the relationship between the minimum dot pitch D and the nozzle pitch, and is an integer of 1 or more. For example, if the nozzle pitch is 180 dpi (1/180 inch) and the dot pitch in the carrying direction is 720 dpi (1/720 inch), then k=4. In the example of the drawing, the nozzles Nz of the nozzle rows are assigned a number (#1 to #180) that decreases as proximity to the downstream side in the carrying direction increases. That is, the nozzle Nz(#1) is located more downstream in the carrying direction, that is, more toward the upper end side of the paper S, than the nozzle Nz(#180).

With the printer 1, a plurality of types of ink can be ejected from each of the nozzles Nz in differing amounts. For example, it is possible to eject three types of ink droplets from the nozzles Nz, those being a large ink droplet of an amount that can form a large dot, a medium ink droplet of an amount that can form a medium dot, and a small ink droplet of an amount that can form a small dot. Thus, in this example, it is possible to perform four types of control, these being no dot formation corresponding to the pixel data "00", formation of a small dot corresponding to the pixel data "01", formation of a medium dot corresponding to the pixel data "10", and formation of a large dot corresponding to the pixel data "11". That is, it is possible to achieve recording in four gradations.

The sensor group 50 is for monitoring the conditions of the printer 1. The sensor group 50 includes a linear encoder 51, a rotary encoder 52, a paper detection sensor 53, and a paper width sensor 54. The linear encoder 51 is a sensor for detecting the position of the carriage CR (head 41, nozzles Nz) in the carriage movement direction. The rotary encoder 52 is a sensor for detecting a rotation amount of the carry roller 23. The paper detection sensor 53 is a sensor for detecting the position of the front end of the paper S being printed. The paper width sensor 54 is a sensor for detecting the width of the paper S being printed.

The printer-side controller 60 is for performing control of the printer 1. As mentioned above, the printer-side controller 60 and the host-side controller 1140 together make up the controller CTR. The printer-side controller 60 has an interface section 61, a CPU 62, a memory 63, and a control unit 64. The interface section 61 is between the computer 1100, which is an external device, and the printer 1, and is for sending and receiving data between the two. The CPU 62 is a computation processing device for performing the overall control of the printer 1. The memory 63 is for securing a working area and an area for storing the programs of the CPU 62, for example, and is constituted by a memory element such as a RAM, EEPROM, or a ROM. The CPU 62 controls the control targets via the control unit 64 in accordance with the computer program stored on the memory 63.

<Regarding the Print-Control Operation>

Figure 12:
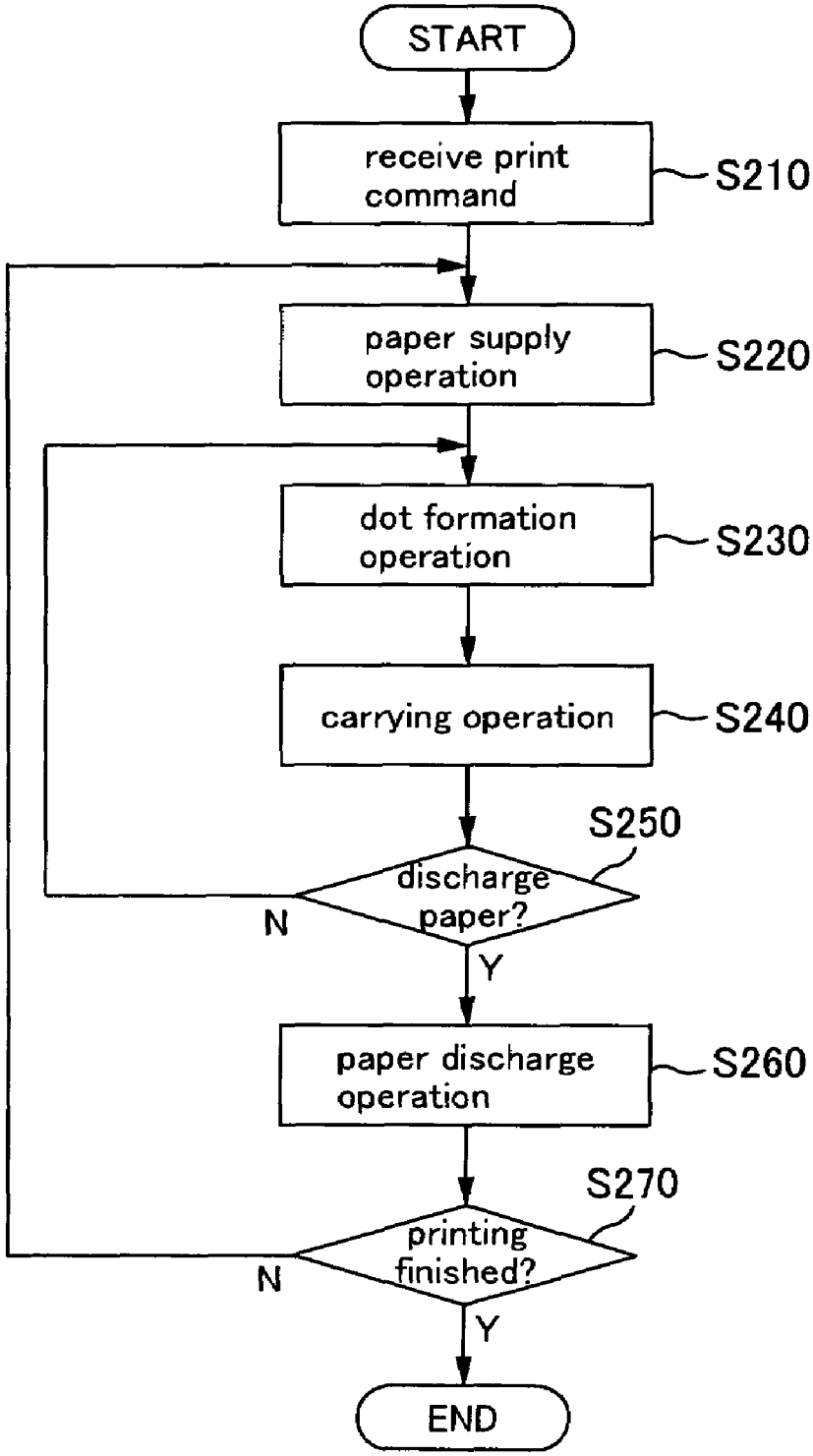
FIG. 12 is a flowchart for describing a print-control operation.

In the printer 1 having the above configuration, the printer-side controller 60 controls the control targets (paper carry mechanism 20, carriage movement mechanism 30, head unit 40) in accordance with a computer program stored on the memory 63. Thus, the computer program has codes for executing those controls. By controlling the control targets, an image is printed on the paper S. Here, FIG. 12 is a flowchart for describing the print-control operation that is performed by the printer-side controller 60. The print-control operation is described below.

Receive Print Command (S210): The printer-side controller 60 receives a print command from the computer 1100 via the interface section 61. The print command is included in the header of the print data transmitted from the computer 1100. The printer-side controller 60 then analyzes the content of the various commands included in the print data that have been received and controls the control targets to perform a paper supply operation, a dot formation operation, a carrying operation, and a paper discharge operation, which are discussed below.

Paper Supply Operation (S220): Once the print command has been received, the printer-side controller 60 causes the paper supply operation to be performed. The paper supply operation is a process for moving the paper S, which is the medium to be printed, and positioning it at a print start position (the so-called indexed position). That is, the printer-side controller 60 rotates the paper feed roller 21 so as to feed the paper S to be printed up to the carry roller 23. Then, the printer-side controller 60 rotates the carry roller 23 to position the paper S that has been fed from the paper feed roller 21 at the print start position.

Dot Formation Operation (S230): Next, the printer-side controller 60 causes the dot formation operation to be performed. The dot formation operation is an operation for forming dots on the paper S by intermittently ejecting ink from nozzles Nz that are moved in the carriage movement direction. It should be noted that in the following description, the operation of moving the nozzles Nz from one side to the other side, or from the other side to the one side, in the carriage movement direction a single time while they eject ink will be regarded as a "pass." In the dot formation operation, the printer-side controller 60 operates the carriage motor 31 so as to move the carriage CR in the carriage movement direction. Also, the printer-side controller 60 causes ink to be ejected from the nozzles Nz based on the print data while the carriage CR is moving. Dots are formed on the paper when ink that has been ejected from the nozzles Nz lands on the paper. Consequently, when the dot formation operation is performed, dots are suitably formed in a unit area UA oriented in the carriage movement direction (see FIG. 13B, etc.). Put differently, raster lines R made of these dots are formed in each of these unit areas UA oriented in the movement direction of the nozzles Nz. Each of the raster lines R is a type of unit image. Thus, the dot formation operation corresponds to the unit image formation operation.

Carrying Operation (S240): Next, the printer-side controller 60 causes the carrying operation to be performed. The carrying operation is an operation for moving the paper S in the carrying direction. The printer-side controller 60 actuates the carry motor 22 to rotate the carry roller 23 and thereby carry the paper S in the carrying direction. Due to the carrying operation, the relative positions of the nozzles Nz and the paper S changes, and this allows dots to be formed at a position in the carrying direction different from the position of the dots formed in the dot formation operation immediately prior (that is, in a different unit area UA). Consequently, a plurality of raster lines R are formed in the carrying direction by repeatedly performing the dot formation operation and the carrying operation, printing the image on the paper S.

Paper Discharge Determination (S250): Next, the printer-side controller 60 performs a determination of whether or not to discharge the paper S being printed. In this determination, the paper is not discharged if there remain data to be printed on the paper S that is being printed. In other words, the dot formation operation is performed. The printer-side controller 60 then alternately performs the dot formation operation and the carrying operation until there are no longer any remaining data for printing, gradually printing an image made of dots on the paper S. Once there are no longer any data with which to print the paper S being printed, the printer-side controller 60 performs a paper discharge process. It should be noted that the determination of whether or not to perform the paper discharge process can also be performed due to a paper discharge command that is included in the print data.

Paper Discharge Operation (S260): If it is determined that the paper should be discharged in the previous paper discharge determination, the printer-side controller 60 causes a paper discharge operation of discharging the paper S for which printing has finished to be performed. In the paper discharge operation, the printer-side controller 60 rotates the paper discharge roller 25 so as to discharge the printed paper S to the outside.

Print Over Determination (S270): Next, the printer-side controller 60 determines whether or not to continue printing. If a next paper S is to be printed, then the procedure is returned to the paper supply operation and printing is continued, and the paper supply operation for the next paper S is started. If a next paper S is not to be printed, then the series of processing operations is ended.

<Regarding the Printing Operation>

Figure 13A:
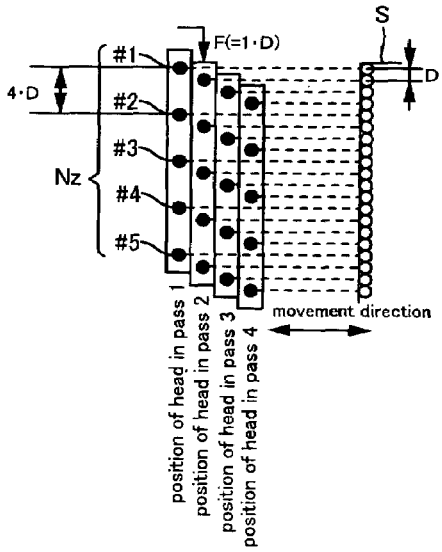
FIG. 13A is a diagram describing an example of printing to an end portion of the paper.
Figure 13C:
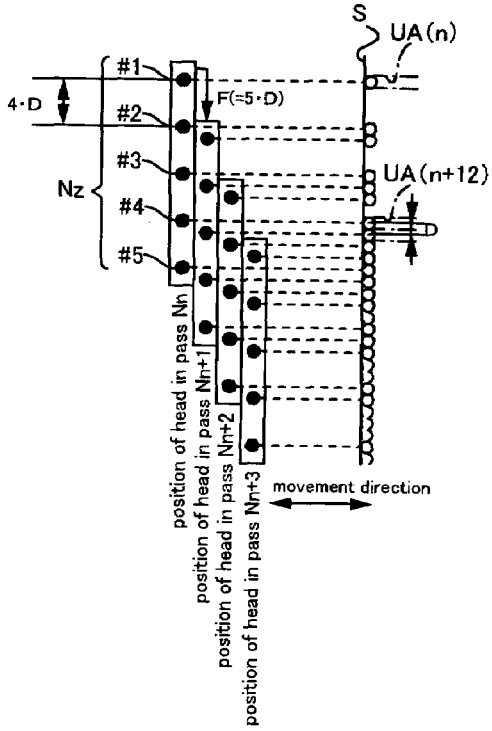
FIG. 13C is a diagram describing an example of printing to an intermediate portion of the paper.
Figure 13B:
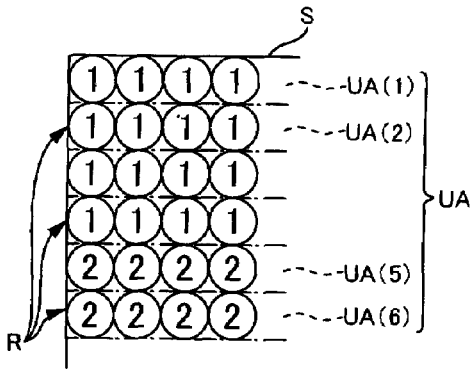
FIG. 13B is a diagram for schematically illustrating a relationship between unit areas, raster lines, and the responsible nozzles in the case of printing as in the example of FIG. 13A.
Figure 13D:
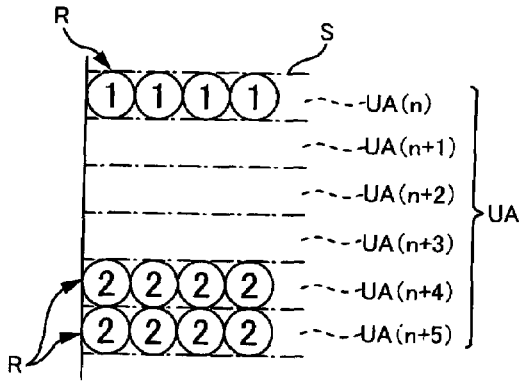
FIG. 13D is a diagram for schematically illustrating a relationship between unit areas, raster lines, and the responsible nozzles in the case of printing as in the example of FIG. 13C.

Next, the printing operation that is achieved through the print-control operation discussed above is described. Here, FIG. 13A is a diagram for describing an example of printing an end portion of the paper. FIG. 13B is a diagram for schematically illustrating the relationship between the unit areas UA, the raster lines R, and the corresponding nozzles Nz in the case of printing as in the example of FIG. 13A. FIG. 13C is a diagram for describing an example of printing an intermediate portion of the paper S. FIG. 13D is a diagram for schematically illustrating the relationship between the unit areas UA, the raster lines R, and the corresponding nozzles Nz in the case of printing as in the example of FIG. 13C.

It should be noted that the end portion of the paper S means the end portions of the paper S in the carrying direction, and includes the upper end portion and the lower end portion. In the example of FIG. 13A, printing is performed with respect to the upper end portion of the paper S. For the sake of convenience, in the following description the operation of printing to the upper end portion of the paper S is referred to as the upper end processing operation. Likewise, the operation of printing to the lower end portion of the paper S is referred to as the lower end processing operation. Also, the intermediate portion of the paper S means the intermediate portion of the paper S in the carrying direction, that is, the portion sandwiched by the upper end portion and the lower end portion. In general, the length of the intermediate portion of the paper S in the carrying direction is longer than the length of the end portions of the paper S in the carrying direction. Thus, the operation of printing the intermediate portion of the paper S is performed more often than the operation of printing to the end portions of the paper S. For this reason, in the following description the operation of printing to the intermediate portion of the paper S is called the normal printing operation.

Additionally, the interlacing mode has been chosen as the print mode in FIGS. 13A to 13D. Here, interlacing is a print mode in which at least one raster line R that is not formed is set between raster lines that are formed in a single dot formation operation, and by performing a plurality of dot formation operations, the raster lines R are formed in a complementary manner. Also, FIG. 13A and FIG. 13C have been drawn in such a manner that it appears that the nozzle row (for the sake of convenience, it is made of five nozzles Nz) shown in place of the head 41 is moving in the carrying direction, but in actually, it is the paper S that moves in the carrying direction.

The operation of printing the end portions of the paper is achieved through a first print-control operation (this corresponds to the first print-control step). In the operation of printing the end portions of the paper, raster lines R are formed in each of the unit areas UA of the upper end portion and the lower end portion of the paper S. The nozzles Nz that are used and the carry amount by which the paper S is carried are determined so to be able to form the raster lines R in each of the unit areas UA in a small number of passes using as many nozzles Nz as possible. For example, in the example of FIG. 13A and FIG. 13B, the paper carry amount F is set to 1•D (one dot, one unit area).

In the upper end processing operation, which is shown as the example in the drawings, in the initial pass (hereinafter, also called pass 1; same applies for other passes) the nozzle Nz(#1) forms a raster line R in the first unit area UA from the paper upper end (hereinafter, also called the first unit area UA; same applies for other unit areas UA), and the nozzle Nz(#2) forms a raster line R in the fifth unit area UA(5). Similarly, the nozzle Nz(#3) forms a raster line R in the ninth unit area UA, the nozzle Nz(#4) forms a raster line R in the 13th unit area UA, and the nozzle Nz(#5) forms a raster line R in the 17th unit area UA. In pass 2, the nozzle Nz(#1) forms a raster line R in the second unit area UA(2) and the nozzle Nz(#2) forms a raster line R in the sixth unit area UA(6). Similarly, the nozzle Nz(#3) forms a raster line R in the tenth unit area UA, the nozzle Nz(#4) forms a raster line R in the 14th unit area UA, and the nozzle Nz(#5) forms a raster line R in the 18th unit area UA. When the same operation is performed in pass 3 and pass 4, raster lines R are formed in the first unit area UA(1) through the 20th unit area UA.

It should be noted that, although this will not be described, the raster lines R are formed in the same manner for the lower end portion of the paper S as well. That is, raster lines R are formed through the lower end processing operation mentioned above.

The normal processing operation is achieved through the second print-control operation (this corresponds to the second print-control step). With the normal processing operation, raster lines R are formed in each of the unit areas UA of the intermediate portion of the paper S. Control is performed in order to form the raster lines R in each of the unit areas UA as efficiently and using the largest carry amount as possible. Consequently, the carry amount in the normal processing operation preferably is set larger than the carry amount when printing the paper end portions. For example, as shown in FIG. 13C and FIG. 13D, the paper carry amount F is set to 5•D (the amount of five dots, five unit areas). This is so as to increase the speed with which the intermediate portion of the paper S is printed.

In the normal processing operation, in pass Nn, the nozzle Nz(#1) forms a raster line R in the n-th unit area UA(n), and the nozzle Nz (#2) forms a raster line R in the n+4th unit area UA(n+4). Similarly, the nozzle Nz(#3) forms a raster line R in the n+8th unit area UA, the nozzle Nz(#4) forms a raster line R in the n+12th unit area UA(n+12), and the nozzle Nz(#5) forms a raster line R in the 16th unit area UA. In pass Nn+1, the nozzle Nz(#1) forms a raster line R in the n+1th unit area UA(n+1), and the nozzle Nz(#2) forms a raster line R in the n+5th unit area UA(n+5). Similarly, the nozzle Nz(#3) forms a raster line R in the n+9th unit area UA, the nozzle Nz(#4) forms a raster line R in the n+13th unit area UA, and the nozzle Nz(#5) forms a raster line R in the n+17th unit area UA.

In the normal processing operation that is illustratively shown in the drawings, unit areas UA in which raster lines R cannot be formed occur in the range from the nth unit area UA(n) to the n+12th unit area UA(n+12). For example, a raster line R cannot be formed using the normal processing operation in the range from the n+1th unit area UA(n+1) to the n+3th unit area UA(n+3). Consequently, raster lines R are formed in these unit areas UA through the operation of printing to the paper end portions discussed above. In other words, the range from the nth unit area UA(n) to the n+12th unit area UA(n+12) can be regarded as a mixed range in which raster lines R (unit images) that are printed in the first print-control operation and raster lines R that are printed in the second print-control operation are mixed in the carrying direction.

<Regarding Darkness Non-uniformities in the Printed Image>

Figure 14:
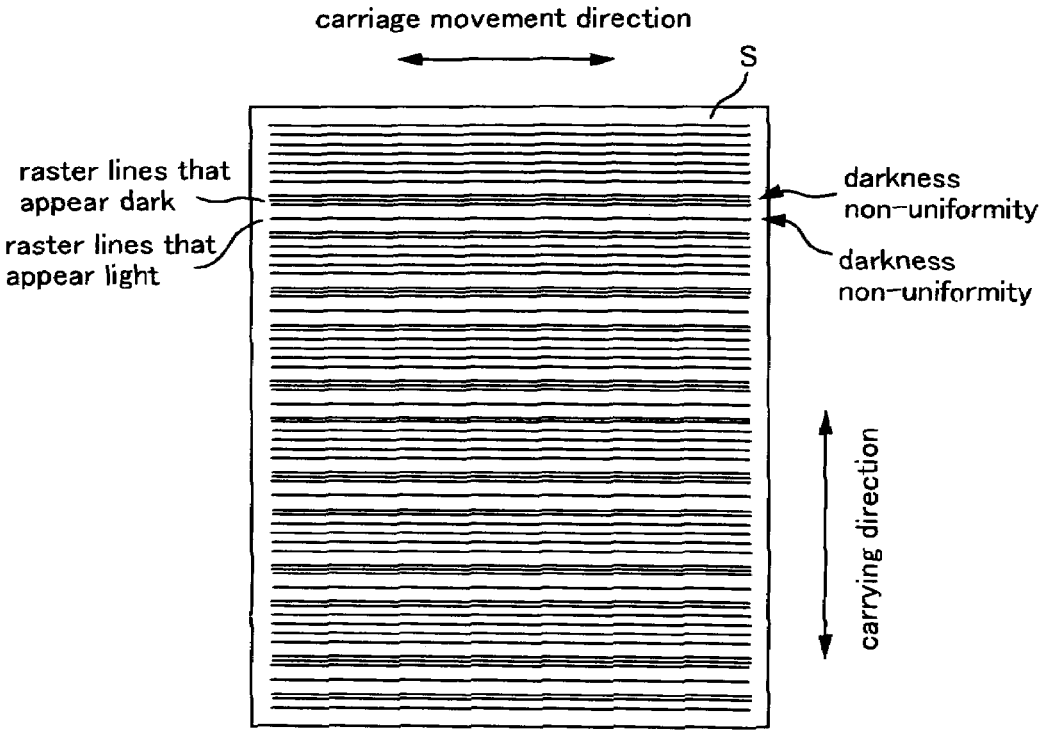
FIG. 14 is a diagram for schematically describing darkness non-uniformities in the printed image.

Darkness non-uniformities in the printed image are described next. Here, FIG. 14 is a diagram for schematically explaining the darkness non-uniformities of a printed image. The darkness non-uniformities that are illustratively shown in the drawing appear as bands in the carriage movement direction (for the sake of convenience, these will also be referred to as horizontal bands). These horizontal band-like darkness non-uniformities occur due to discrepancies in the amount of ink that is ejected from each nozzle, for example, but they may also occur due to discrepancies in the travel direction of the ink. That is, when there is a discrepancy in the direction in which the ink travels, the position where a dot is formed by the ink that lands on the paper S will be shifted in the carrying direction with respect to the target formation position. In this case, the position where the raster line R that is made of these dots is formed also will be shifted in the carrying direction off of the target formation position. The result is that the spacing between raster lines adjacent in the carrying direction is widened or narrowed. When viewed macroscopically, these appear as darkness non-uniformities shaped like horizontal bands. In other words, raster lines R whose spacing with respect to an adjacent raster line is relatively wide macroscopically appear light, and those whose spacing with respect to an adjacent raster line R is relatively narrow macroscopically appear dark. Further, such darkness non-uniformities shaped like horizontal bands also can occur if there have been discrepancies in the carrying of the paper S.

<Regarding the Correction Values for Inhibiting Darkness Non-uniformities>

To inhibit such darkness non-uniformities in horizontal bands, it is preferable to adjust the amount of ink for each raster line by setting a correction value H (see FIG. 18) for each raster line, that is, for each unit area, adjacent to one another in the carrying direction. This is because the correction values H are set taking into consideration the combination of the nozzle Nz that is responsible for a particular raster line R and the nozzles Nz that are responsible for the adjacent raster lines R. By doing this, horizontal band-shaped darkness non-uniformities that are the result of shifting in the travel direction can be effectively inhibited. This configuration also allows carry non-uniformities of the paper S to be effectively inhibited. There are various methods that can be employed to set the correction values H, but the method of printing a correction pattern (test pattern) on a medium and then setting correction values H based on the darkness of the correction pattern that has been printed is preferable. This is because darkness non-uniformities can be measured under conditions that are close to the conditions under which the printer will be used, thereby allowing appropriate correction values H to be set.

It should be pointed out that the printed image normally includes a substantial number of unit areas UA. For example, if the print resolution in the carrying direction is 720 dpi, then individually setting a correction value H for each unit area UA would require 720 correction values H per inch in the carrying direction. This would require a memory 63 (correction value storage section) that has a very large capacity, and result in reduced processing speeds and higher manufacturing costs for the printer 1.

Overview of the Embodiment

To solve these problems, the printer 1 of the embodiment is provided with a plurality of nozzles Nz that are disposed in a predetermined direction and are moved in a movement direction, a paper carry mechanism (medium carrying section) for carrying the paper S (medium) in a carrying direction that intersects the movement direction, a correction value storage section 63*a* (see FIG. 2) that stores correction values H for correcting the darkness of the raster lines R (unit images) that are formed in each of the unit areas UA, which are each oriented in the movement direction and are adjacent to one another in the carrying direction, and a controller CTR (host-side controller 1140, printer-side controller 60). The controller CTR performs a first print-control operation (this corresponds to the first print-control step) of printing an image to an end portion of the paper S in the carrying direction by repeatedly performing a dot formation operation (S230, unit image formation operation) of ejecting ink from the nozzles Nz to form raster lines R and a first carrying operation (S240) of carrying the paper S by a predetermined carry amount, a second print-control operation (this corresponds to the second print-control step) of printing an image to an intermediate portion of the paper S in the carrying direction by repeatedly performing the dot formation operation (S230) and a second carrying operation (S240) of carrying the paper S by another predetermined carry amount, and corrects the darkness of the raster lines R in the mixed range, in which the raster lines R that are printed in the first print-control operation and the raster lines R that are printed in the second print-control operation are mixed in the carrying direction, based on the correction values H that are used in the second print-control operation. In this case, it is preferable that the correction values H that are used in the second print-control operation are determined in a periodic manner based on the combination of the nozzles Nz and the unit areas UA.

The printer 1 of the embodiment having this configuration has the following advantages. That is, correcting the darkness of the raster lines R based on the correction values H allows the quality of the printed image to be increased. Further, the darkness of the raster lines R of the mixed rage is corrected based on the correction values H that are used in the second print-control operation, and thus the required capacity of the memory 63 for storing the correction values H can be reduced. Also, because the correction values H that are used in the second print-control operation are determined in a periodic manner based on the combination of nozzles Nz and unit areas UA, the required capacity of the memory 63 can be further reduced.

The main features of the printer 1 of the embodiment are described in detail below, focusing on these aspects.

<Regarding the Processes Up to The Actual Printing>

Figure 15:
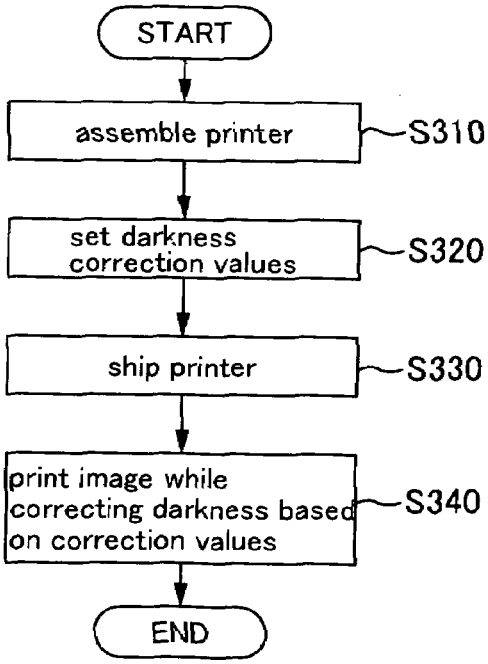
FIG. 15 is a flowchart for describing the process from assembly of the printer to an actual printing.

FIG. 15 is a flowchart for briefly describing the processes that are performed between the assembly of the printer 1 according to the embodiment and the actual printing that is performed under control by the user. These processes are described with reference to the flowchart. First, the printer 1 is assembled on a manufacturing line (S310). Next, a worker on the manufacturing line sets a correction value H for each unit area in the printer 1 (S320). That is, in this step, the correction values H for each unit area are stored on the memory 63, and more specifically the correction value storage section 63*a*, of the printer 1. Once the correction values H for each unit area have been set, the printer 1 is shipped (S330). Then, a user who has purchased the printer 1 causes actual printing of an image to be performed (S340). In actual printing, the printer 1 performs darkness correction based on the correction values H. That is, the printer 1 forms raster lines R such that they are at the corrected darkness.

The printer 1 of the embodiment is characterized in the step of setting the correction value H (step S320) and the actual printing of an image (step S340). For that reason, the following description is made with regard to the step of setting the correction value H and the actual printing of an image.

<Step S320: Setting the Correction Values H>

Figure 16:
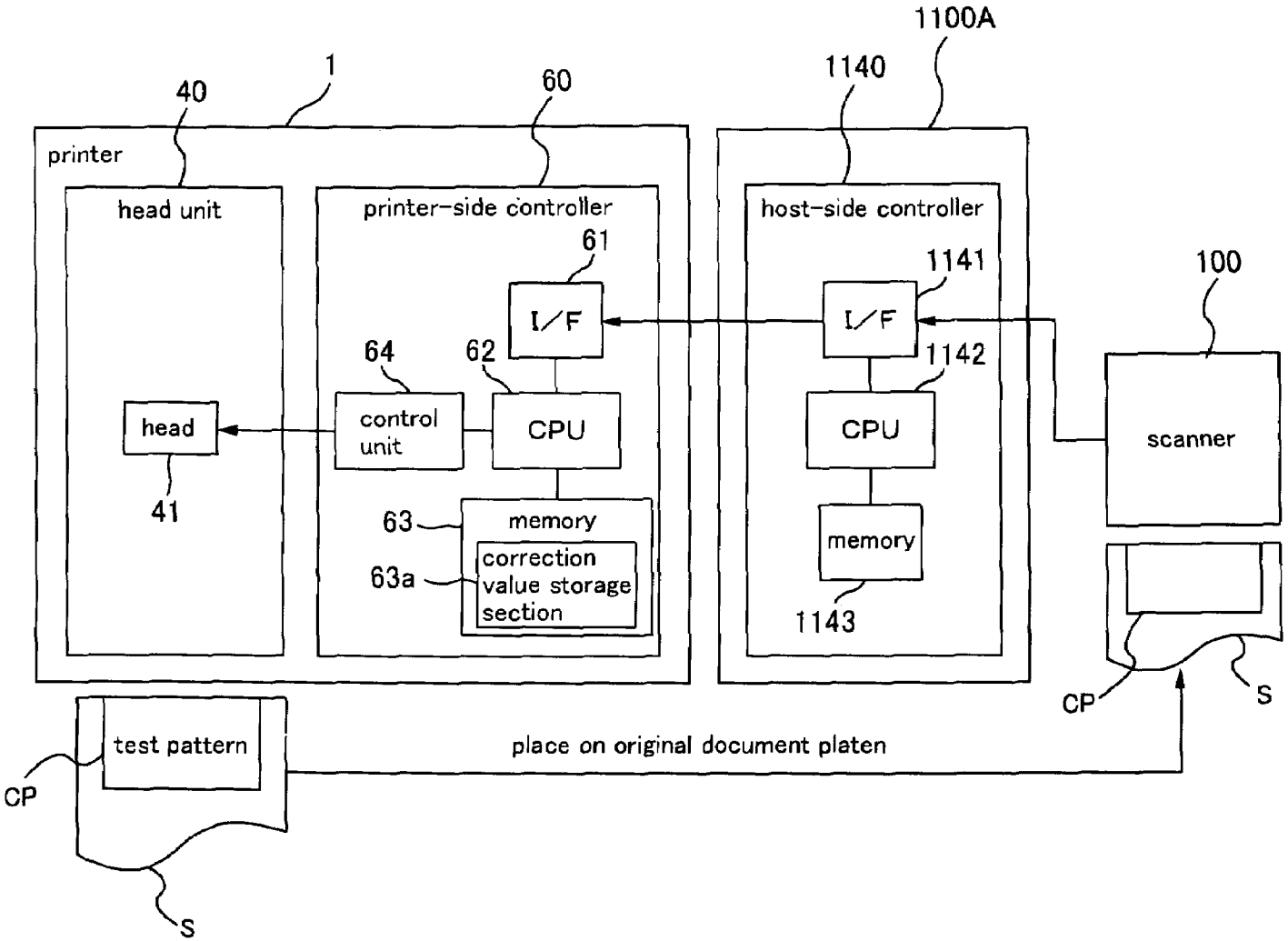
FIG. 16 is a block diagram for describing devices that are used to set correction values.

First, the device that is used to set the correction values H will be described. FIG. 16 is a block diagram for describing this device. It should be noted that structural elements that have already been described are assigned the same reference numerals as before and thus will be not be described. In this drawing, a computer 1100A is a computer that is installed on the inspection line. A memory 1143 of the computer 1100A stores a correction program for this step. This correction program is one type of application program 1120 and achieves a process for obtaining correction values H (correction value obtaining process), and has codes for achieving this process. The device illustratively shown in the drawing includes a scanner device 100. The scanner device 100 corresponds to a darkness reading device, and is for reading the darkness of an image that has been printed on an original document (for example, a correction pattern CP that has been printed on the paper S) at a predetermined resolution.

FIG. 17 is a conceptual diagram of a record table that is provided in the memory 1143 of the computer 1100A. This illustrative record table is provided with records for each raster line and fields for each color. In this embodiment, each record is associated with a raster line R, the raster lines R formed on the upper end side of the paper being stored in sequence starting from the lowest number record. The number of records is determined in correspondence with the number of raster lines R that are to be read out. Four fields are provided for the respective colors cyan, magenta, yellow, and black.

FIG. 18 is a conceptual diagram of the correction value storage section 63*a* provided in the memory 63 of the printer 1. The correction value storage section 63*a* stores a correction value H for each unit area. The correction value storage section 63*a* that is illustratively shown here stores the correction values H in association with a record number. Here, each record is divided into three groups. That is, a first group GR1 stores the upper end processing correction values, which are the correction values H for the upper end portion. A second group GR2 stores the normal processing correction values, which are the correction values H for the intermediate portion. A third group GR3 stores the lower end processing correction values, which are the correction values H for the lower end portion.

Figure 24:
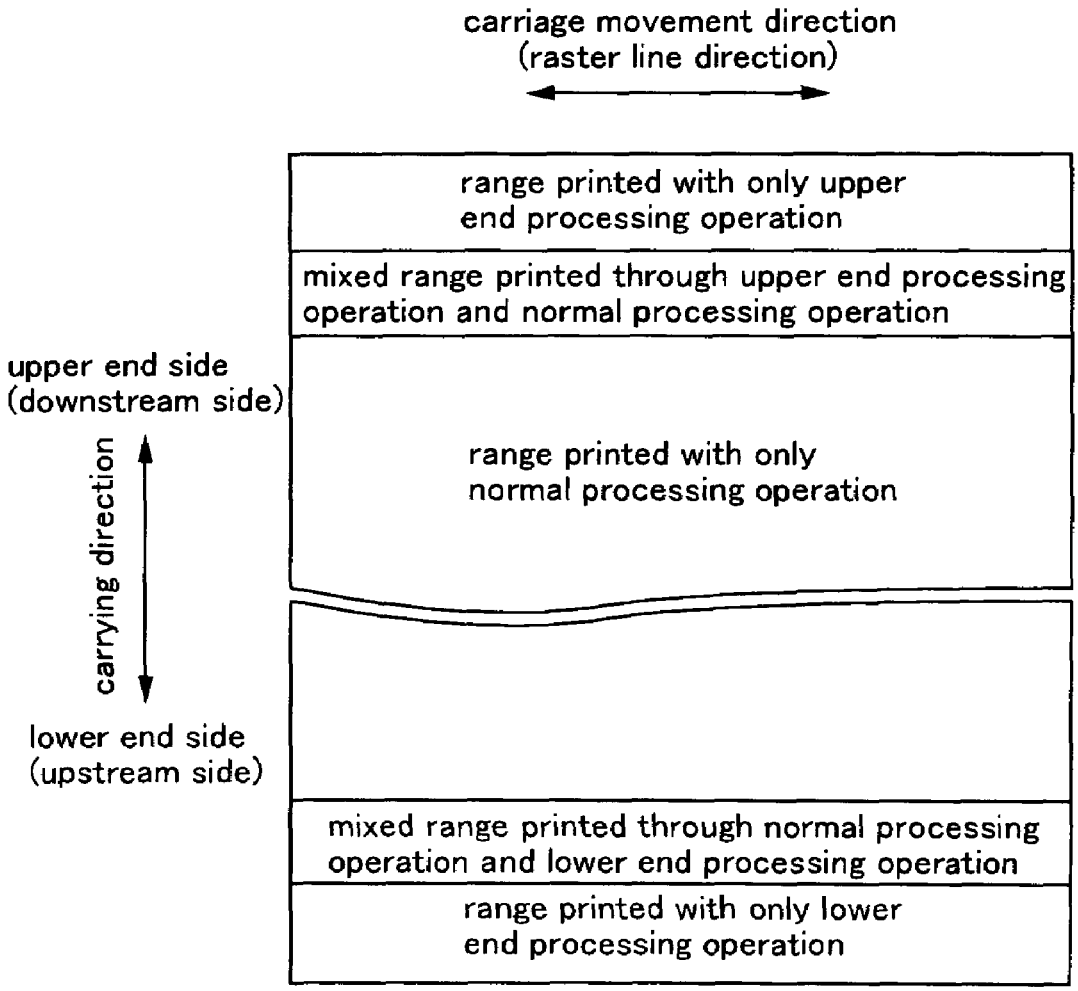
FIG. 24 is a conceptual diagram showing the print areas of an image, separated by processing operation.
Figure 25:
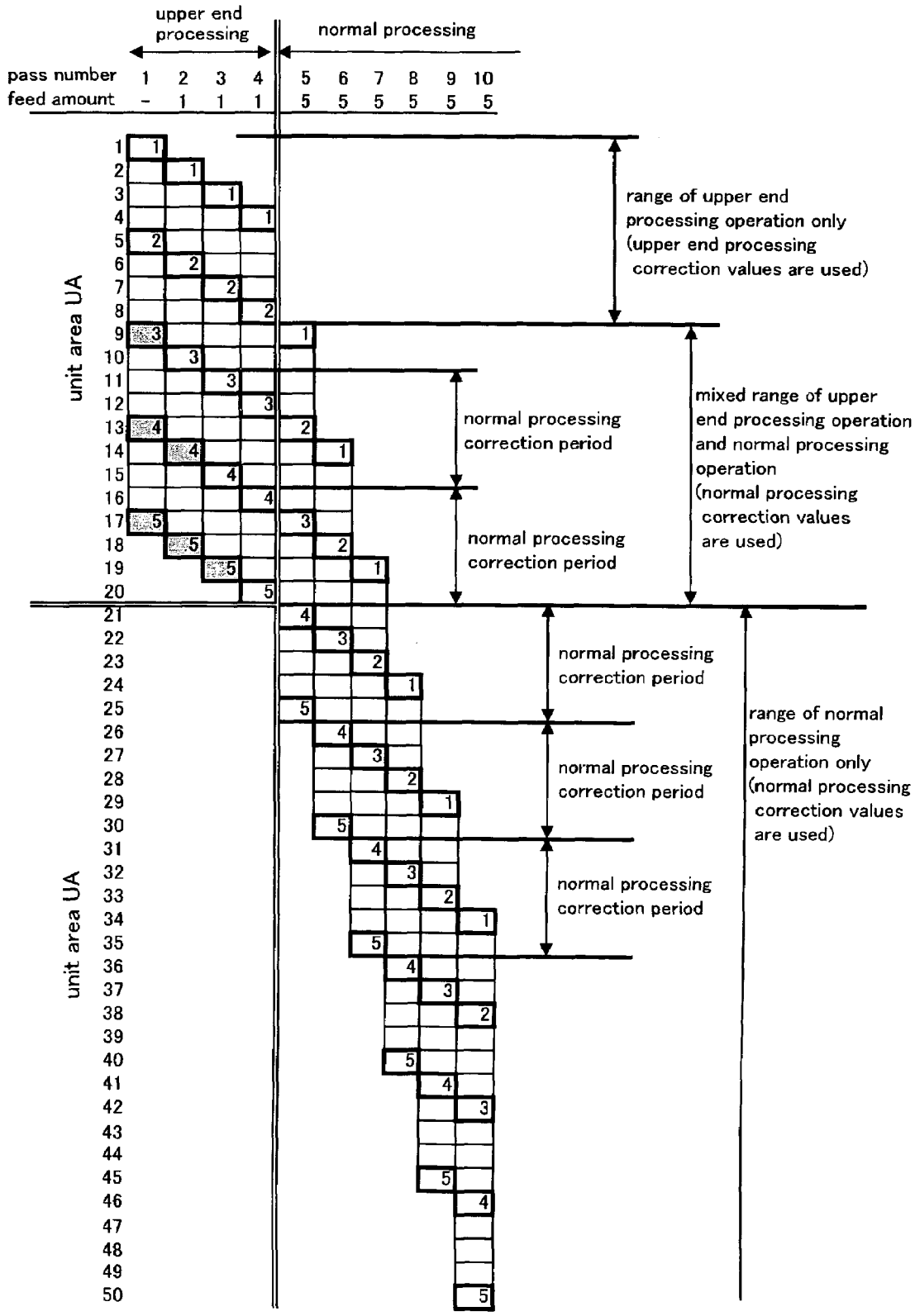
FIG. 25 is a diagram that schematically shows a range that is printed by only an upper end processing operation, a range that is printed by only a normal processing operation, and a mixed range that is printed by the upper end processing operation and the normal processing operation.

The upper end processing correction values are used for the range that is printed using the upper end processing operation only. In the example of FIGS. 24 and 25, the range that is printed only with the upper end processing operation corresponds to the first unit area UA(1) to the eighth unit area UA(8). Thus, the first group GR1 in this example is made of eight unit areas (R1 to R8), and a capacity of that amount is secured in the correction value storage section 63*a* as the capacity for the upper end processing correction values.

Figure 26:
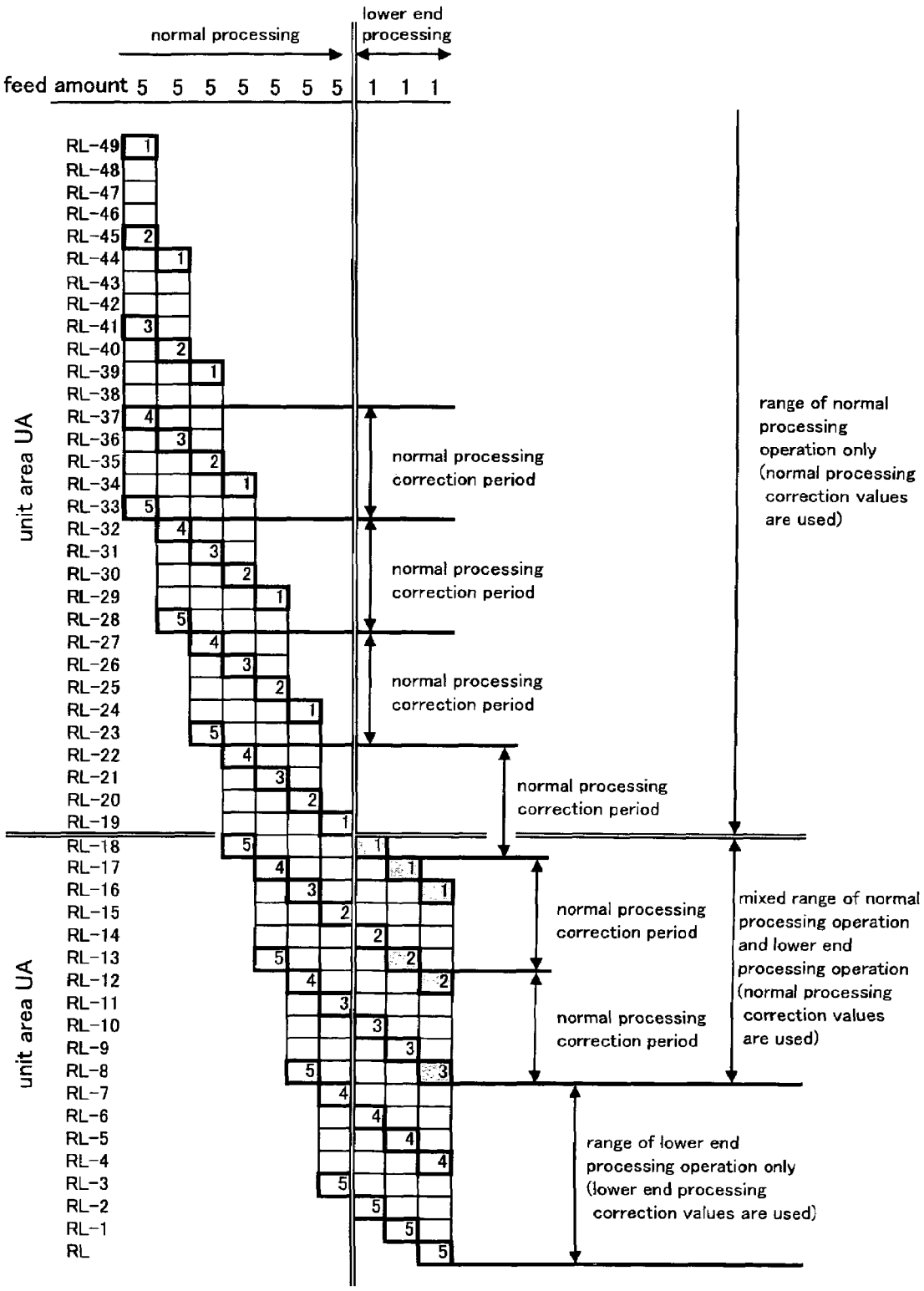
FIG. 26 is a diagram that schematically shows a range that is printed by only a normal processing operation, a range that is printed by only a lower end processing operation, and a mixed range that is printed by the normal processing operation and the lower end processing operation.

The normal processing correction values are values that are used in the mixed range that is printed with the upper end processing operation and the normal processing operation, the range that is printed only with the normal processing operation, and the mixed range that is printed with the normal processing operation and the lower end processing operation. In the example of FIGS. 24 to 26, the mixed range that is printed with the upper end processing operation and the normal processing operation corresponds to the ninth unit area UA(9) to the twentieth unit area UA(20). The range that is printed only with the normal processing operation corresponds to the 21st unit area UA(21) to the nineteenth area from the final unit area UA(RL-19). The mixed range that is printed with the normal processing operation and the lower end processing operation corresponds to the eighteenth area from the final unit area UA(RL-18) to the eighth area from the final unit area UA(RL-8).

A predetermined number of normal processing correction values are determined based on the correction pattern CP (test pattern) that is printed with only the normal processing operation. In the normal processing operation, the combination of responsible nozzles Nz and raster lines R is determined in a periodic manner, and thus a predetermined number of normal processing correction values are determined in correspondence with this period.

In the example of FIGS. 25 and 26, the nozzle Nz(#4) is responsible for the first raster line R that is printed only with the normal processing operation (the 21st raster line R) and the nozzle Nz(#3) is responsible for the next raster line R (the 22nd raster line R). Similarly, the nozzle Nz(#2) is responsible for the 23rd raster line R, the nozzle Nz(#1) is responsible for the 24th raster line R, and the nozzle Nz(#5) is responsible for the 25th raster line R. This combination of raster lines R and nozzles Nz, specifically the combination of nozzle Nz(#4), nozzle Nz(#3), nozzle Nz(#2), nozzle Nz(#1), and nozzle Nz(#5), appears periodically. For example, it appears for the range of the 26th raster line R through the 30th raster line R and for the range of the 31st raster line R through the 35th raster line R.

Since the combination of raster lines R and nozzles Nz appears in a periodic manner in this way, a sufficient correcting effect can be obtained by preparing only as many correction values H as this combination and repeatedly using those correction values. For the sake of convenience, the period of correction values H determined by this combination will be referred to as the normal processing correction period. In the example of FIG. 24 and FIG. 25, there are five correction values H in the normal processing correction period. Thus, the second group GR2 in this example is provided for the five unit areas (C1 to C5), and a capacity of that amount is secured in the correction value storage section 63*a* as a capacity for the normal processing correction values.

The lower end processing correction values are used for the range that is printed only with the lower end processing operation. In the example of FIG. 24, the range that is printed only with the lower end processing operation corresponds to the seventh area from the final unit area UA(RL-7) to the final unit area UA(RL). Thus, the third group GR3 in this example is provided for eight unit areas (RL-7 to RL), and a capacity of that amount is secured in the correction value storage section 63*a* as the capacity for the lower end processing correction values.

In this embodiment, the normal processing correction values that are stored in the second group GR2 are also used for the raster lines R that are formed in the mixed range of the upper end processing operation and the normal processing operation and the mixed range of the normal processing operation and the lower end processing operation, and thus the amount of the memory 63 that is used can be reduced by that amount. Further, the normal processing correction values are determined periodically based on the combination of the nozzles Nz and the unit areas UA and used repeatedly. In this regard as well, the amount of the memory 63 (correction value storage section 63*a*) that is used can be reduced. In the example of FIGS. 25 and 26, the overall usage of the memory 63 can be kept to a capacity for 21 unit areas.

It should be noted that the above discussion is made with regard to the example of FIGS. 25 and 26, and thus the areas that are prepared in the correction value storage section 63*a* are for the eight unit areas for the first group, the five unit areas for the second group, and the eight unit areas for the third group. However, the amount of the areas is determined by the number of nozzles Nz and the print mode.

Figure 19A:
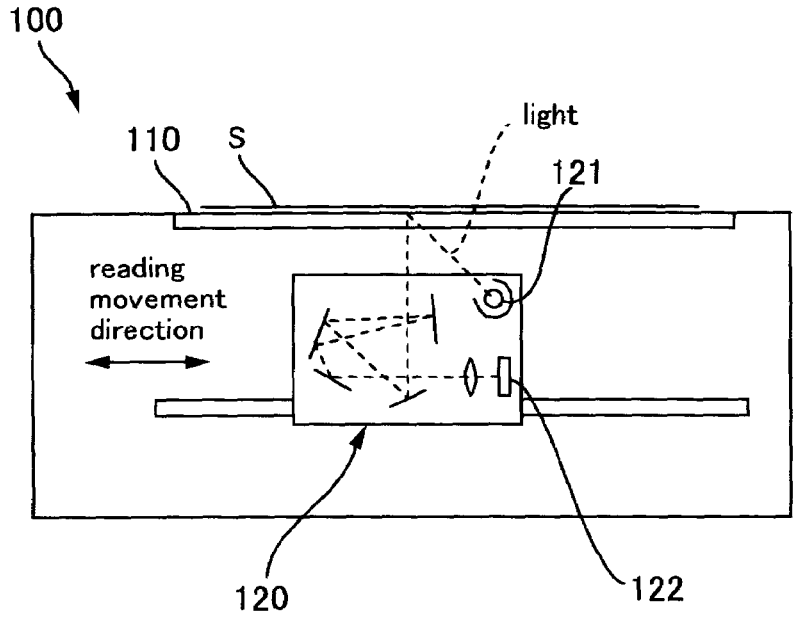
FIG. 19A is a vertical sectional view of a scanner device.
Figure 19B:
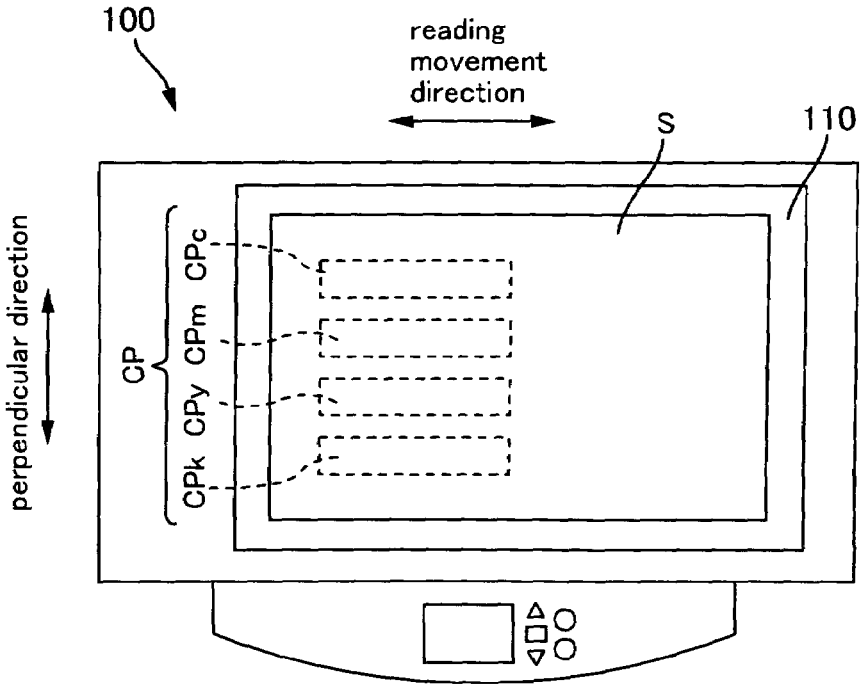
FIG. 19B is a plan view of the scanner device.

FIG. 19A and FIG. 19B are diagrams for describing the scanner device 100 that is communicably connected to the computer 1100A. That is, FIG. 19A is a vertical section of the scanner device 100. FIG. 19B is a plan view of the scanner device 100. The scanner device 100 corresponds to a darkness reading device, and reads the darkness of an image that has been printed on an original document (for example, a correction pattern CP that has been printed on the paper S) at a predetermined resolution. The scanner device 100 is provided with an original document platen glass 110 on which original documents are placed, a reading carriage 120 that is in opposition to the original document through the original document platen glass 110 and that moves in a predetermined movement direction, and a scanner controller (not shown) that controls various sections of the reading carriage 120, for example. The reading carriage 120 is provided with an exposure lamp 121 that irradiates light onto the original document, and a linear sensor 122 that receives light reflected by the original document over a predetermined range in a perpendicular direction that is perpendicular to the movement direction. With the scanner device 100, the reading carriage 120 is moved in the movement direction while the exposure lamp 121 emits light. The linear sensor 122 receives the light that is reflected from the original document. Thus, the scanner device 100 reads the darkness of the image that is printed on the original document at a predetermined reading resolution. The scanner device 100 of the embodiment can read the darkness of the image at a higher resolution than the print resolution of the image. For example, it can read the darkness of an image that has been printed at a resolution of 720 dpi at a reading resolution of 1800 to 2800 dpi. It should be noted that the dashed line in FIG. 19A indicates the path of the light when reading the darkness of the image.

Figure 20:
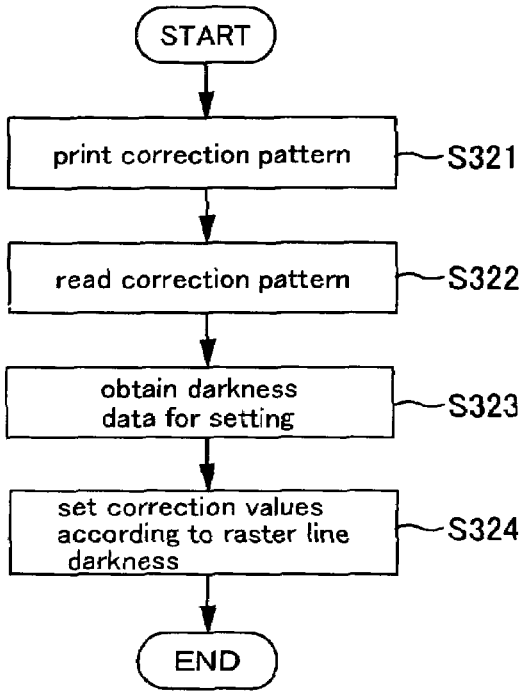
FIG. 20 is a flowchart showing a procedure for setting the correction values.

The procedure for setting the correction values H is described next. Here, FIG. 20 is a flowchart that indicates the procedure of the process for setting the correction values according to step S320 of FIG. 15. This procedure has a print step of printing a correction pattern CP (test pattern) (S321), a step of reading the correction pattern (S322), a step of converting the resolution to obtain darkness data for setting (S323), and a correction value setting step of setting a correction value H with regard to each raster line R for each darkness (S324).

Printing the Correction Pattern CP (S321): First, in step S321, a correction pattern CP is printed to the paper S. Here, a worker on the inspection line communicably connects the printer 1 to the computer 1100A on the inspection line. He then causes the printer 1 to print a correction pattern CP. In other words, the worker issues a command through a user interface of the computer 1100A to print a correction pattern CP. At that time, the print mode and the paper size mode, etc., are set through the user interface. Due to this command, the computer 1100A reads the image data of the correction pattern CP that is stored on the memory 1143 and performs the resolution conversion, color conversion, halftone processing, and rasterizing discussed above. The result of this is that print data for printing a correction pattern CP are output to the printer 1 from the computer 1100A. The printer 1 then prints the correction pattern CP on the paper S based on the print data. That is, the printer 1 prints the correction pattern CP through the same printing operation as that when printing an image (the actual printing discussed later). It should be noted that the printer 1 that prints the correction pattern CP is the printer 1 for which correction values H are to be set. That is, correction values H are set for each and every printer.

Figure 21:
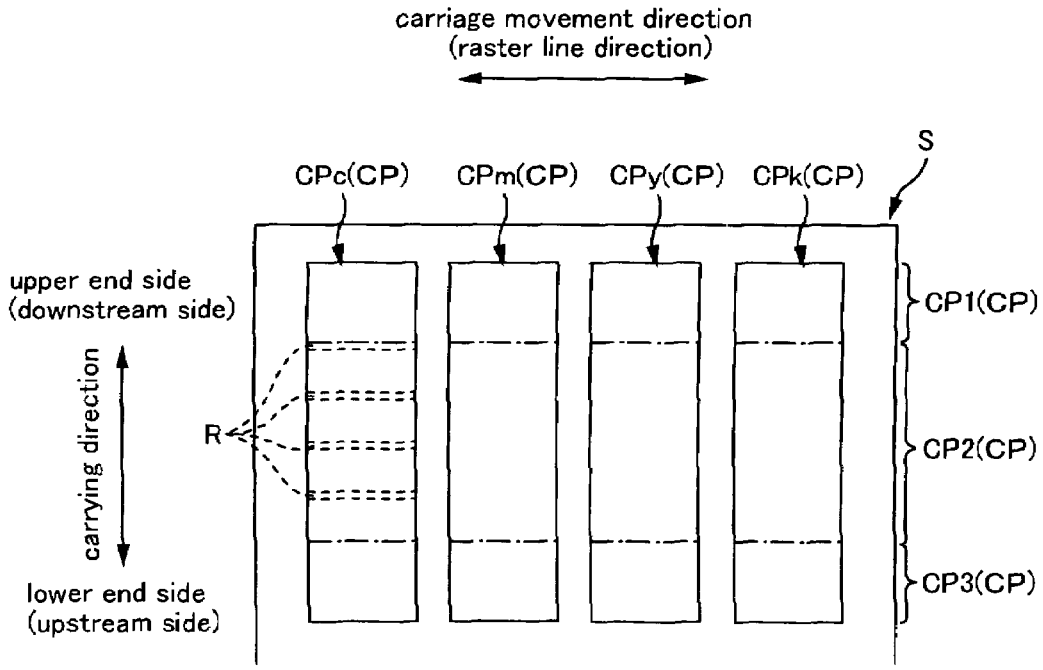
FIG. 21 is a diagram illustrating an example of a correction pattern that has been printed.

Here, FIG. 21 is a diagram for describing an example of the correction pattern CP (test pattern) that has been printed. With the correction pattern CP illustratively shown in the drawing, a single rectangular pattern is long in the carrying direction. Four of these patterns are printed in the carriage movement direction (raster line direction; the direction in which the nozzles Nz are moved). Each of these patterns is a different color. In the example of FIG. 21, a cyan correction pattern CPc, a magenta correction pattern CPm, a yellow correction pattern CPy, and a black correction pattern CPk are printed in that order from the left side. The correction patterns CP have the same shape. That is, they have the same width (print length in the carriage movement direction) and length (print length in the carrying direction).

The upper end portion CP1, the intermediate portion CP2, and the lower end portion CP3 of the correction pattern CP in the carrying direction are printed through different printing operations. That is, the upper end portion CP1 of the correction pattern CP is printed with the upper end processing operation. The intermediate portion CP2 of the correction pattern CP is printed with the normal processing operation. Further, the lower end portion CP3 of the correction pattern CP is printed with the lower end processing operation. Regarding the intermediate portion CP2 of the correction pattern CP, the number of raster lines R in the intermediate portion CP2 of the correction pattern CP is set to be a number amounting to a plurality of normal processing correction periods discussed above. This is to increase the accuracy of the correction values H. Put simply, the correction values H are obtained from the mean darkness of corresponding raster lines R from among the raster line groups of different normal processing correction periods. It should be noted that this is described in further detail later.

Reading the Correction Pattern (step S322): Next, the darkness of the correction pattern CP that has been printed is read by the scanner device 100. First, a worker on the inspection line places the paper S on which the correction pattern CP has been printed onto the original document platen glass 110. At this time, as shown in FIG. 19B, the worker places the paper S such that the direction in which the paper S was carried is the same as the reading movement direction of the reading carriage 120. Once the paper S has been placed, the worker sets the reading conditions through the user interface of the computer 1100A and then performs a command to initiate reading. When the scanner device 100 has received the command to start reading, its scanner controller (not shown) controls the reading carriage 120, for example, so as to read the correction pattern CP that has been printed on the paper S.

Here, the reading resolution of the scanner device 100 in the reading movement direction preferably is finer than half of the raster line R spacing (pitch). This is based on the sampling theory that "the sampling frequency must be at least twice the frequency of the maximum frequency included in the sampling target." In this embodiment, the pitch between raster lines R is 720 dpi, and thus the scanner device 100 reads the darkness of the image at a reading resolution of 1800 dpi, which is finer than half of the raster line pitch. The scanner device 100 then transfers the darkness data that it has obtained (the darkness data of the entire area to be read) to the computer 1100A. The computer 1100A records the darkness data on the memory 1143.

Obtaining the Darkness Data for Setting (step S323): Next, the computer 1100A is made to obtain the darkness data for setting that are used to set the correction values H. The computer 1100A obtains the setting darkness data based on the darkness data that have been transferred from the scanner device 100. First, the computer 1100A converts the resolution of the darkness data that have been transferred thereto into the printing resolution based on the darkness data that have been transferred thereto from the scanner device 100. For example, darkness data whose reading resolution is 1800 dpi are converted into darkness data of 720 dpi, which is the print resolution. Thus, the darkness data after conversion become data that indicate the darkness of each raster line.

Once the resolution conversion has been performed, the computer 1100A obtains the darkness data for each raster line in the correction pattern CP based on the darkness data whose resolution has been converted. That is, the computer 1100A chooses the correction pattern CP of a target color and obtains the darkness data of that chosen correction pattern CP over varying positions in the carrying direction. Any appropriate method can be employed to obtain the darkness data. In this embodiment, the computer 1100A obtains the darkness based on the coordinate information.

Once the darkness data of each raster line have been obtained, the computer 1100A obtains the mean darkness of corresponding raster lines R among the raster line groups in different normal processing correction periods. In the illustrative cyan correction pattern CPc of FIG. 21, the intermediate portion CP2 includes a number of raster lines R that amount to four normal processing correction periods. In this case, the computer 1100A obtains the darkness data for raster lines R whose combination of nozzles Nz is the same from each normal correction period. In this example, the computer 1100A obtains darkness data for four raster lines R. Once the darkness data of the raster lines R have been obtained, the computer 1100A calculates the mean value of the darkness data that have been obtained. The mean value that is calculated is stored on the memory 1143 as the mean darkness data. The mean darkness data are obtained for each raster line R of the normal processing correction period.

Setting a Correction Value H for Each Raster Line R (step S324): Next, the computer 1100A calculates the correction values H based on the darkness data for the raster lines R that have been obtained. The correction values H are obtained, for example, in the form of correction ratios that indicate the rate by which the darkness gradation value is corrected. Specifically, they are calculated as follows. First, the mean value dav of the darkness data of all of the raster lines R is calculated for a correction pattern CP having the same color. Then, for each raster line, the computer 1100A calculates the deviation Δd between the darkness data d of that raster line R and the mean darkness value dav (=dav−d) and takes the value obtained by dividing this deviation Δd by the mean value dav as the correction value H. That is, when expressed as an equation, the correction value H is expressed as follows.

$$\text{correction value } H = \Delta d / dav \qquad \text{(Eq. 1)}$$
$$= (dav - d) / dav$$

For example, in a case where the darkness data d of a particular raster line R is 95 and the mean value dav of the darkness data in that correction pattern CP is 100, then the correction value H is calculated as ((100−95)/100) and becomes +0.05. Likewise, in a case where the darkness data d of a particular raster line R is 105 and the mean value dav of the darkness data in that correction pattern CP is 100, then the correction value H is calculated as ((100−105)/100) and becomes −0.05. In this way, if the darkness data d of a particular raster line R is smaller than the mean value dav of the darkness data in that correction pattern CP, that is, if the darkness is lighter than the standard, then the correction value H is positive. Conversely, the correction value H is negative if the darkness is darker than the standard. It should be noted that, although discussed later, a positive correction value H results in correction for darkening the darkness of that raster line R, whereas a negative correction value H results in correction for lightening the darkness of that raster line R.

The computer 1100A also sets the upper end processing correction values, the normal processing correction values, and the lower end processing correction values. Of these correction values H, the upper end processing correction values and the lower end processing correction values are individually set for each raster line R. Here, the upper end processing correction values are set for the section that is printed only with the upper end processing operation, that is, the unit areas UA in which raster lines R are formed through the upper end processing operation only. Those unit areas UA constitute only a small proportion of all of the unit areas UA that are printed on the paper S. For example, in the examples of FIG. 25 and FIG. 26, there are eight unit areas. Similarly, the lower end processing correction values are set for the section that is printed only with the lower end processing operation, that is, the unit areas UA in which raster lines R are formed through the lower end processing operation only. Those unit areas UA also constitute only a small proportion of all of the unit areas UA that are printed on the paper S. Consequently, it is possible to minimize the memory capacity for storing the upper end processing correction values and lower end processing correction values. Further, it is only necessary to determine an amount of normal processing correction values that corresponds to the normal processing correction period. For example, in the example of FIGS. 25 and 26, the normal processing correction period is made of five unit areas UA, and thus that number of normal processing correction values will suffice. Further, as mentioned above, the darkness data of a plurality of corresponding raster lines R in different normal processing correction periods are selected and the mean value of the selected darkness data is used to calculate the normal processing correction values. Thus, darkness non-uniformities resulting from carrying discrepancies of the paper S also are dispersed, and this allows the precision of the normal processing correction values to be increased.

The computer 1100A then stores the correction values H obtained in this way, that is, the upper end processing correction values, the normal processing correction values, and the lower end processing correction values, on the correction value storage section 63*a* of the printer 1.

<Step S340: Actual Printing of an Image While Correcting the Darkness for Each Raster Line>

The printer 1 in which darkness correction values H have been set in this way and shipped is used by a user. That is, an actual printing is performed by the user. In an actual printing, the host-side controller 1140 and the printer-side controller 60 work in concert to collectively function as the controller CTR. The host-side controller 1140 and the printer-side controller 60 correct the darkness for each raster line so as to performing printing in which darkness non-uniformities have been inhibited. That is, the host-side controller 1140 references the correction values H stored on the correction value storage section 63*a* and corrects the darkness of the image data based on those correction values H that have been referenced. More specifically, under control by the printer driver 1130, the host-side controller 1140 corrects the multi-gradation pixel data based on the correction values H when converting the RGB image data to print data. It then outputs the print data based on the image data after correction to the printer 1. The printer-side controller 60 prints the corresponding raster lines R based on the print data that have been output.

Figure 22:
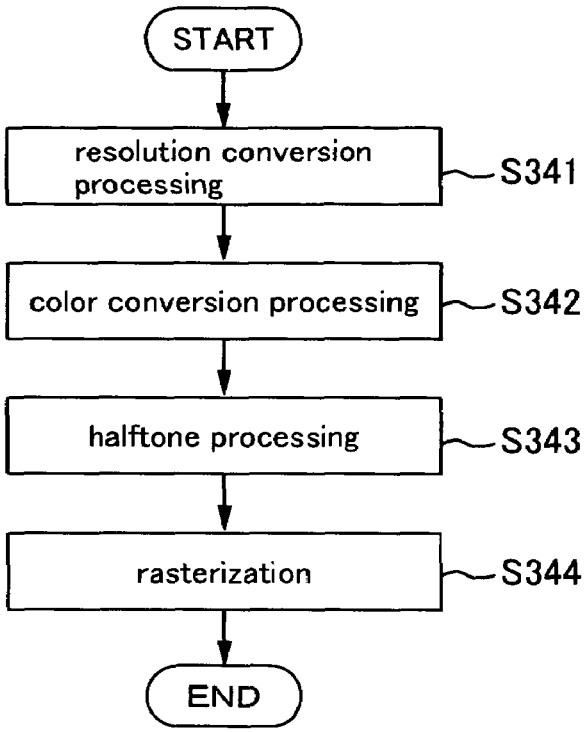
FIG. 22 is a flowchart that shows a procedure for darkness correction for each raster line.

FIG. 22 is a flowchart showing the procedure for correcting the darkness of each raster line in step S340 of FIG. 15. Hereinafter, the darkness correction procedure is described with reference to this flowchart. It should be noted that in the following description the processing of the host-side controller 1140 that is performed under control by the printer driver 1130 is described as the processing of the printer driver 1130.

In this procedure, first the printer driver 1130 performs resolution conversion (step S341). The printer driver 1130 then successively performs color conversion (step S342), halftone processing (step S343), and rasterization (step S344). It should be noted that these processes are performed in a state where the user has communicably connected the printer 1 to the computer 1100 to establish the printing system 1000 illustrated in FIG. 1. Specifically, these processes are performed under the condition that the printing execution is effected through the user interface screen of the printer driver 1130, with the image quality mode, the paper size mode, and other required information entered. These processes have been described already, and thus here the description focuses on points of difference. Specifically, differences caused by the correction values H are described with regard to halftone processing.

In halftone processing, the darkness is corrected for each raster line. That is, darkness correction based on the correction values H is performed when converting pixel data having gradation values of 256 grades into pixel data of four gradations. In this embodiment, through halftone processing the gradation values of 256 grades are converted into gradation values of four grades after first being turned into level data. Accordingly, at the time of this conversion, the pixel data of four gradations are corrected by changing the gradation values of 256 grades by the amount of the correction value H. Thus, in halftone processing, the corresponding correction value H is selected in the process for setting large dot level data LVL (S101), the process for setting medium dot level data LVM (S103), and the process for setting small dot level data LVL (S105). The level data are then changed based on the correction value H that has been selected.

Figure 23:
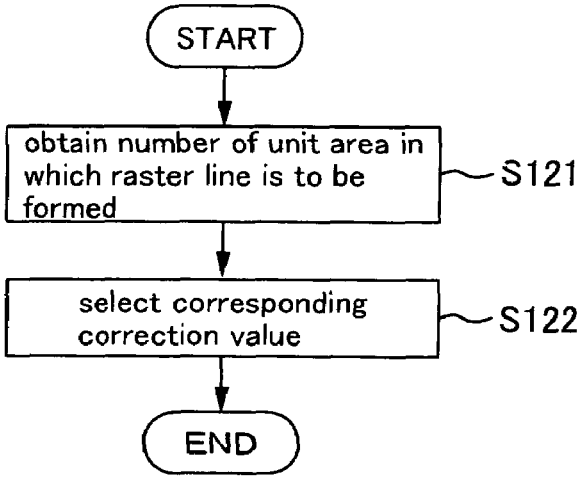
FIG. 23 is a flowchart for describing a process for selecting the correction values.

Here, FIG. 23 is a flowchart for describing the process for selecting the correction values H. FIG. 24 is a conceptual diagram showing the print regions of the image, separated by processing operation. FIG. 25 is a diagram that schematically shows the range that is printed only with the upper end processing operation, the range that is printed only with the normal processing operation, and the mixed range that is printed with the upper end processing operation and the normal processing operation. FIG. 26 is a diagram that schematically shows the range that is printed only with the normal processing operation, the range that is printed only with the lower end processing operation, and the mixed range that is printed with the normal processing operation and the lower end processing operation.

In the process for selecting a correction value H, first the number of the unit area UA in which the raster line R is to be formed is obtained (step S121). Next, the correction value H corresponding to the number of the unit area UA that has been obtained is obtained (step S122). The following specific example is used to provide a detailed description of selection of the correction value H. The printer driver 1130 determines the print mode based on the print conditions that have been set (image quality mode, for example). The printer driver 1130 then associates the unit areas UA and the correction values H to be used for that print mode that has been determined. In the example of FIG. 25 and FIG. 26, the printer driver 1130 associates the upper end processing correction values with the unit areas UA from the first unit area UA(1) to the eighth unit area UA(8). Similarly, the printer driver 1130 associates the lower end processing correction values with the unit areas UA from the seventh unit area from the final unit area UA(RL-7) to the final unit area UA(RL).

Further, the printer driver 1130 associates the normal processing correction values, as they are, with the unit areas UA within the mixed range of the upper end processing operation and the normal processing operation, the range that is printed with the normal processing operation only, and the mixed range of the normal processing operation and the lower end processing operation. This association is made taking the range that is printed only with the normal processing operation as a reference. That is, the normal processing correction values are associated with the unit areas UA of the range that is printed only with the normal processing operation in order from the upper end side in the carrying direction. In this case, the normal processing correction values are used repeatedly. Then, the normal processing correction values are associated with the unit areas UA of the mixed range of the upper end processing operation and the normal processing operation in such a manner that they are in continuation with the normal processing correction values that have been associated with the unit areas UA of the range that is printed with the normal processing operation only. Similarly, the normal processing correction values are associated with the unit areas UA of the mixed range of the normal processing operation and the lower end processing operation in such a manner that they are in continuation with the normal processing correction values that have been associated with the unit areas UA of the range that is printed with the normal processing operation only.

In the example of FIGS. 25 and 26, the 21st unit area UA(21), which is located at the uppermost end in the carrying direction among the unit areas UA of the range that is printed with the normal processing operation only, serves as the reference. The first normal processing correction value in the normal processing correction period is associated with that 21st unit area UA(21). The second normal processing correction value in the normal processing correction period is associated with the 22nd unit area UA(22) that is adjacent on the downstream side to that unit area UA. Likewise thereafter, the third normal processing correction value in the normal processing correction period is associated with the 23rd unit area UA(23), the fourth normal processing correction value in the normal processing correction period is associated with the 24th unit area UA(24), and the fifth normal processing correction value in the normal processing correction period is associated with the 25th unit area UA(25). The normal processing correction values are similarly associated for the other unit areas UA as well. For example, the first through fifth normal processing correction values in the normal processing correction period are again associated with the 26th unit area UA(26) through the 31st unit area UA(31).

Then, the normal processing correction values are associated with the mixed range of the upper end processing operation and the normal processing operation in such a manner that they are in continuation with the normal processing correction values of the range that is printed with the normal processing operation only. For example, the fifth normal processing correction value in the normal processing correction period is associated with the 20th unit area UA(20) that is adjacent on the upstream side to the 21st unit area UA(21). Similarly, the fourth normal processing correction value in the normal processing correction period is associated with the 19th unit area UA(19), and the third normal processing correction value in the normal processing correction period is associated with the 18th unit area UA(18). The same applies to the mixed range of the normal processing operation and the lower end processing operation. For example, the fifth normal processing correction value in the normal processing correction period is associated with the 18th unit area from the final unit area UA(RL-18).

In this manner, the normal processing correction values are set in a periodic manner to the unit areas UA of the mixed range of the upper end processing operation and the normal processing operation, the range that is printed with the normal processing operation only, and the mixed range of the normal processing operation and the lower end processing operation. That is, the normal processing correction values are repeatedly associated from the ninth unit area UA(9) through the eighth unit area from the final unit area UA(RL-8).

By associating the normal processing correction values in this way, a sufficient correction effect is attained for the region that is printed in only the normal processing operation. Further, an appreciable correction effect can also be obtained for the mixed range of the upper end processing operation and the normal processing operation and the mixed range of the normal processing operation and the lower end processing operation. This is because these mixed ranges also include raster lines R that are printed with the normal processing operation. In other words, these mixed ranges include raster lines R that are formed through the normal processing operation, although the proportion of such raster lines R decreases as the distance from the range that is printed with only the normal processing operation increases. Additionally, even for raster lines R that are formed in the upper end processing operation and the lower end processing operation, there are raster lines R that have the same nozzle Nz combination as raster lines R in the normal processing operation. These raster lines R can be effectively corrected using the normal processing correction values.

Then, as mentioned above, in the process for setting large dot level data LVL (S101), the process for setting medium dot level data LVM (S103), and the process for setting small dot level data LVS (S106), the level data are read out while changing the gradation values by the amount of the associated correction values H.

That is, the gradation value gr of the pixel data is multiplied by the correction value H to obtain Δgr, and the gradation value gr of the pixel data is changed to gr+Δgr. Then, the printer driver 1130 reads the level data based on this gradation value gr+Δgr. Using the example of FIG. 4, the gradation value gr is changed by +Δgr to obtain 11 d for the large dot level data LVL, 12 d for the medium dot level data LVL, and 13d for the small dot level data LVL. This computation can be performed easily and quickly. Thus, the processing can be simplified and can comply with the high-frequency ejection of ink.

The level data that have been read in this manner become the print data and are output to the printer 1 during rasterization. The printer 1 then performs an actual printing of the image onto the paper S in accordance with those print data. With regard to the print data used here, the darkness has been corrected for each raster line. Thus, darkness non-uniformities can be effectively inhibited in the printed image.

Second Embodiment

Figure 27:
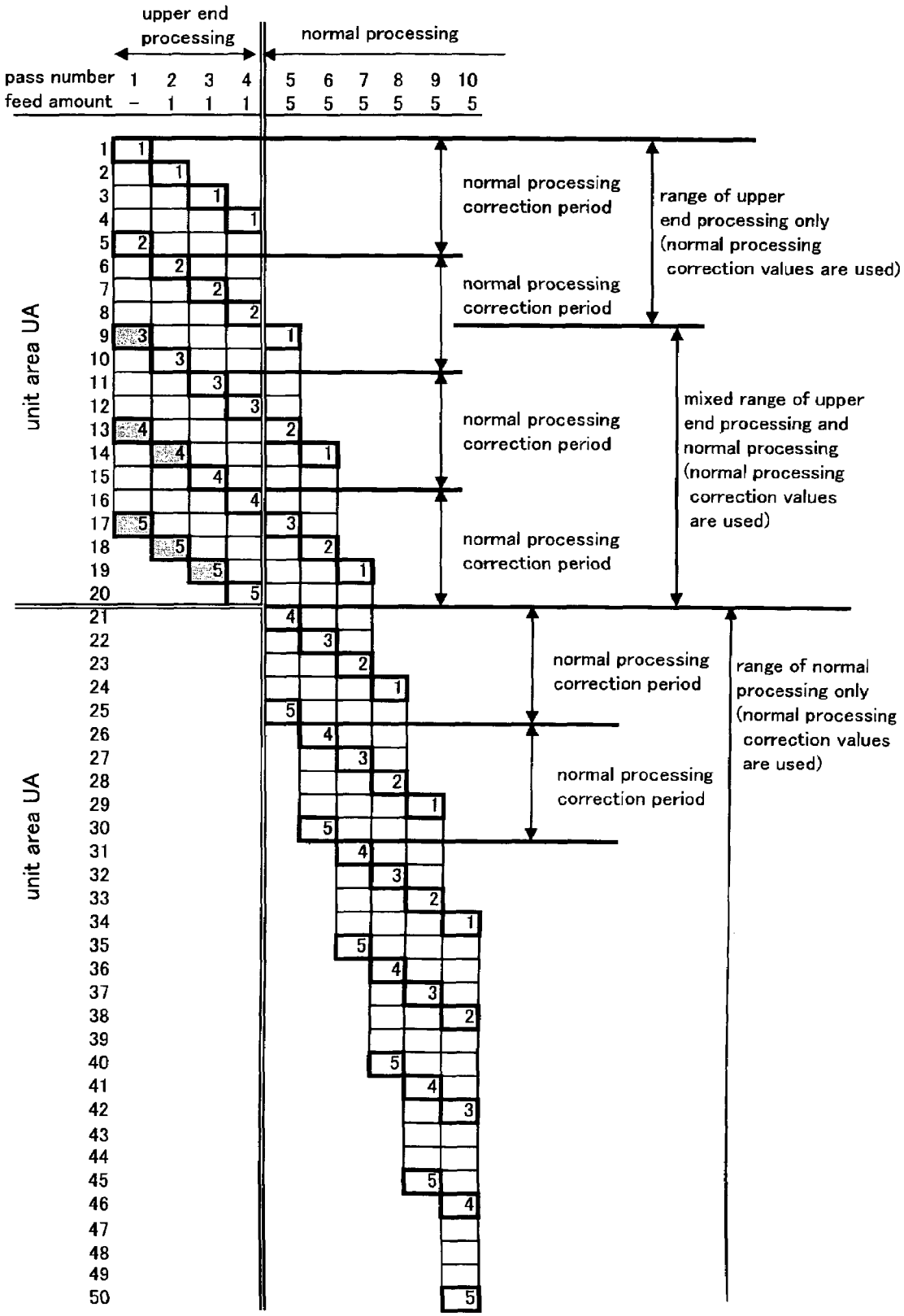
FIG. 27 is a diagram for describing a second embodiment.

FIG. 27 is a diagram for describing the second embodiment, and schematically illustrates another method for setting the normal processing correction values. It should be noted that FIG. 27 corresponds to FIG. 25 in the first embodiment.

The second embodiment differs from the first embodiment in that the normal processing correction values are also used for the range that is printed with only the upper end processing operation and the range that is printed with only the lower end processing operation. That is, in the second embodiment as well, the range that is printed with only the normal processing operation serves as a reference for determining the normal processing correction values. In this case, the normal processing correction values are repeatedly associated with the unit areas UA from the 21st unit area UA(21) through the 19th unit area from the final unit area UA(RL-19). Then, the normal processing correction values are repeatedly associated with the range in which the normal processing operation and the upper end processing operation are mixed, the range that is printed with only the upper end processing operation, the range in which the normal processing operation and the lower end processing operation are mixed, and the range that is printed with only the lower end processing operation.

For example, as shown in FIG. 27, the normal processing correction values are repeatedly associated with the range in which the normal processing operation and the upper end processing operation are mixed and the range that is printed with only the upper end processing operation in a manner that is continuous with the unit areas UA of the range that is printed with only the normal processing operation. It should be noted that although not shown, the same also applies for the range in which the normal processing operation and the lower end processing operation are mixed and the range that is printed with only the lower end processing operation.

By adopting this configuration, it is only necessary to store a predetermined number of normal processing correction values in the storage value storage section 63*a* of the memory 63, and thus the memory capacity required for the correction values H can be reduced even further.

Third Embodiment

Figure 28:
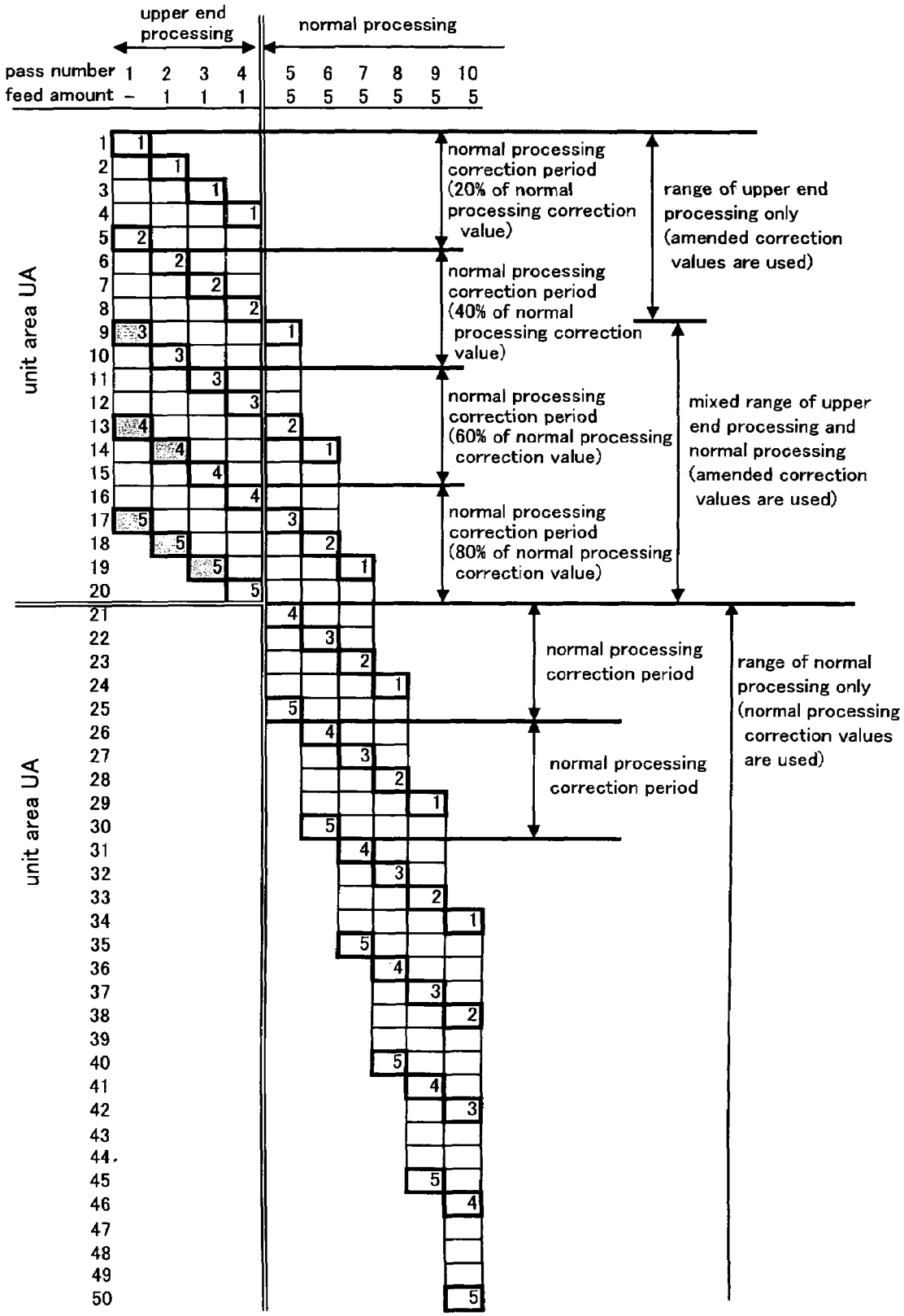
FIG. 28 is a diagram for describing a third embodiment.

FIG. 28 is a diagram for describing the third embodiment, and schematically illustrates another method for setting the normal processing correction values. It should be noted that FIG. 28 corresponds to FIG. 25 of the first embodiment and FIG. 27 of the second embodiment.

In the third embodiment, the normal processing correction values are used for the unit areas UA of the range that is printed with only the normal processing operation. On the other hand, amended correction values are used for the unit areas UA of the mixed range that is printed with the upper end processing operation and the normal processing operation and the unit areas UA of the range that is printed with the upper end processing operation. These amended correction values are obtained by amending the normal processing correction values according to amendment coefficients. These amendment coefficients are set such that the degree of darkness correction decreases as proximity to the end portions in the carrying direction increases. In this case, the amendment coefficients are set in units of normal processing correction periods.

For example, as shown in FIG. 28, an amendment coefficient of 0.8 has been set for the normal processing correction period that is adjacent to the range that is printed with only the normal processing operation (for the sake of convenience, this will be referred to as the fourth correction period), setting the degree of darkness correction to 80% of the normal processing correction value. For the normal processing correction period that is adjacent to the fourth correction period (for the sake of convenience, this will be referred to as the third correction period), an amendment coefficient of 0.6 (correction degree 60%) has been set. Further, for the normal processing correction period that is adjacent to the third correction period (for the sake of convenience, this will be referred to as the second correction period), an amendment coefficient of 0.4 (correction degree 40%) has been set, and for the normal processing correction period that is adjacent to the second correction period (for the sake of convenience, this will be referred to as the first correction period), an amendment coefficient of 0.2 (correction degree 20%) has been set.

By obtaining amended correction values using the amendment coefficients set in this manner and correcting the darkness of the raster lines R based on those amended correction values that have been obtained, the picture quality can be improved. That is, the proportion of unit areas UA that are printed in the normal processing operation increases as proximity to the range that is printed through only the normal printing operation increases. Put differently, the closer the position to this range, the more influence the normal processing operation has on the printing processing operation. Thus, those portions that are influenced by the normal processing operation are corrected to a large extent based on the normal processing correction values, whereas those portions that are not influenced by the normal processing operation are corrected little based on the normal processing correction values, thereby allowing suitable correction to be performed. In short, the degree of correction is determined by the degree of influence by the normal processing operation, and thus suitable correction can be performed.

Further, with this embodiment, the required memory capacity is the capacity that is necessary to store the normal processing correction values and amendment coefficients. Thus, the required memory capacity can be reduced compared to that for a case in which the amended correction values H are determined individually. Thus, this embodiment as well allows the required memory capacity to be sufficiently reduced.

Other Embodiments

The foregoing embodiments primarily describe a printing system 1000 that includes a printer 1, but they also include the disclosure of print-control apparatuses and print-control methods, etc. The foregoing embodiments are for the purpose of facilitating understanding of the present invention, and are not to be interpreted as limiting the present invention. The invention can of course be altered and improved without departing from the gist thereof, and includes equivalents. In particular, the embodiments mentioned below also are within the scope of the invention.

<Regarding the Print Mode>

Figure 29A:
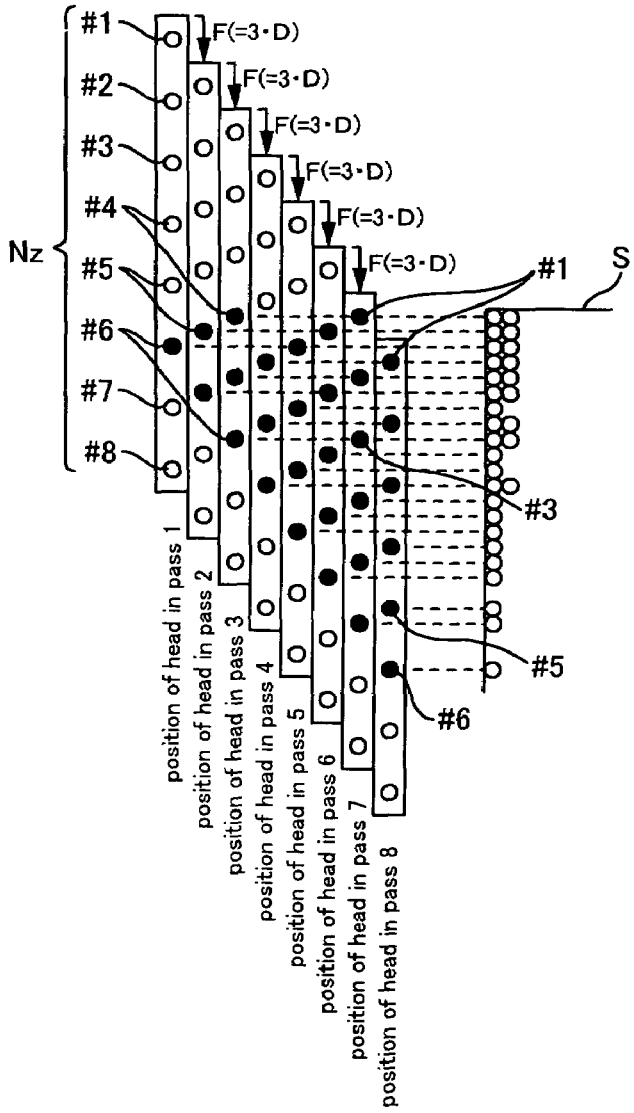
FIG. 29A is a diagram that describes an example of printing by overlapping, and shows the positions of the nozzles relative to the paper in each pass.
Figure 29B:
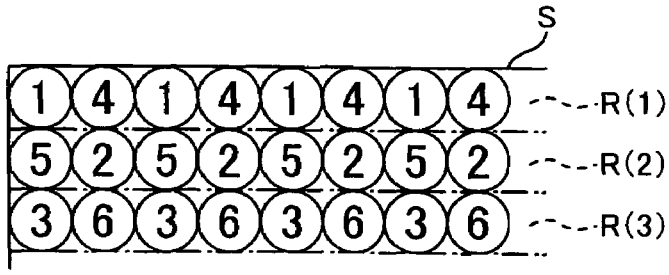
FIG. 29B is a diagram that schematically illustrates a relationship between raster lines that are formed and the responsible nozzles.

Interlacing was described as an example of the print mode in the above embodiments, but the print mode is not limited to this. For example, it is also possible to use a so-called overlapping mode. Here, FIG. 29A is a diagram for describing an example of printing through overlapping, and shows the positions of the nozzles Nz relative to the paper S for each pass. FIG. 29B is a diagram for schematically describing the relationship between the raster lines R that are formed and the responsible nozzles Nz. It should be noted that in these drawings, two nozzles Nz are responsible for a single raster line R.

With overlapping as well as with interlacing, ink is ejected from predetermined nozzles Nz each instance that the paper S is carried by a predetermined carry amount in the carrying direction, forming dots on the paper S. Here, with overlapping, ink is intermittently ejected from the nozzles in a single dot formation operation (pass), forming dots on the paper at a constant pitch. Then, in another pass, ink is intermittently ejected from other nozzles Nz, forming other dots at positions that fill in the space between the dots that have already been formed. By repeating this operation, a single raster line R is completed through a plural number of dot formation operations. For the sake of convenience, if a single raster line R is completed through M-number of dot formation operations, then this is referred to as the overlap number M.

In the example of FIGS. 29A and 29B, the dots are formed every other dot through a single dot formation operation. That is, a single raster line R is completed through two dot formation operations. Thus, the overlap number is 2 (M=2). It should be noted that in the case of interlacing, a single raster line R is completed through one dot formation operation, and thus the overlap number can be said to be 1 (M=1). With overlapping, the following conditions must be met in order to execute recording at a constant paper carry amount F. That is, it is necessary to meet the conditions of: (1) N/M is an integer; (2) N/M is coprime with k; and (3) the paper carry amount F is set to (N/M)·D.

In the example of FIG. 29A, the nozzle row has eight nozzles Nz arranged in the carrying direction. However, since the coefficient k is 4 and the overlap number is 2 (M=2), in order to fulfill the condition of "N/M and k are coprimes" for performing overlapping printing, it is not possible to use all the nozzles Nz. Accordingly, six of the eight nozzles Nz are used to perform interlaced printing. In this case, because N=6, N/M becomes 3, and the paper S is carried by a carry amount 3•D. By setting the number N of nozzles Nz to be used and the carry amount in this way, it is possible to complete a single raster line R in two dot formation operations.

That is, in this example, the initial raster line R1 (raster line R1 at a front end of the paper) is formed by nozzle Nz(#4) in the third dot formation operation (pass 3) and the nozzle Nz(#1) in the seventh dot formation operation (pass 7). Thus, in the third pass, ink is intermittently ejected from nozzle Nz(#4), forming a dot at the spacing of every other dot. In the seventh dot formation operation, ink is intermittently ejected from nozzle Nz(#7), forming a dot at the spacing of every other dot in such a manner that the gap between the dots formed in the third dot formation operation is filled in.

The second raster line R2 is formed by nozzle Nz(#5) in the second dot formation operation (pass 2) and nozzle Nz(#2) in the sixth dot formation operation (pass 6). Thus, the second raster line R2 also is completed in two dot formation operations by filling in the space between the dots formed in the second dot formation operation with the dots that are formed in the sixth dot formation operation.

Similarly, the third raster line R3 is completed through two dot formation operations by nozzle Nz(#6) in the first dot formation operation (pass 1) and nozzle Nz(#3) in the fifth dot formation operation (pass 5).

<Regarding the Printing System>

As regards the printing system, the above embodiments describe a printing system 1000 in which the printer 1 serving as the print apparatus and the computer 1100 serving as the print-control apparatus are configured separately, but there is no limitation to this configuration. For example, the printing system can include the print apparatus and the print-control apparatus as a single unit.

<Regarding the Drive Elements>

In the foregoing embodiments, ink was ejected using piezo elements. However, the mode for ejecting ink is not limited to this. For example, it is also possible to employ other modes such as a mode of generating bubbles within the nozzles Nz through heat.

<Regarding the Ink>

The above embodiments are of a printer 1, and thus a dye ink or a pigment ink is ejected from the nozzles Nz. However, the ink that is ejected from the nozzles Nz is not limited to such inks.

<Regarding Other Application Examples>

A printer 1 was described in the above embodiments, but the present invention is not limited to this. For example, technology like that of the present embodiments can also be adopted for various types of recording apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Also, the methods therefor and manufacturing methods thereof are within the scope of application.

What is claimed is:

1. A print-control method comprising:

a first print-control step of repeatedly performing a unit image formation operation of forming a unit image in a unit area on a medium by ejecting ink from a plurality of nozzles that are arranged in a predetermined direction and that are moved in a movement direction, and a first carrying operation of carrying said medium by a predetermined carry amount, so as to print an image in an end portion, in a carrying direction in which said medium is carried, of said medium; and a second print-control step of repeatedly performing said unit image formation operation and a second carrying operation of carrying said medium by an other predetermined carry amount, so as to print an image in an intermediate portion, in said carrying direction, of said medium;

wherein darkness of each of the unit images within said end portion, in which unit images that are printed in said first print-control step, is corrected based on an end processing correction value, wherein darkness of each of the unit images within said intermediate portion, in which unit images that are printed in said second print-control step, is corrected based on a normal processing correction value, and wherein darkness of each of the unit images within a mixed range, in which unit images that are printed in said first print-control step and unit images that are printed in said second print-control step are mixed in said carrying direction, is corrected using an amended correction value obtained by amending the normal processing correction value that is used in said second print-control step.

2. A print-control method according to claim 1, wherein in said second print-control step, a predetermined number of the normal processing correction values are stored in a correction value storage section, and said normal processing correction values are repeatedly used based on a combination of said nozzles and said unit areas, to perform the darkness correction.

3. A print-control method according to claim 1, wherein said amended correction value is obtained by multiplying the normal processing correction value used in said second print-control step by an amendment coefficient.

4. A print-control method according to claim 3, wherein said amendment coefficient is determined such that a degree of darkness correction becomes smaller as proximity to the end portion, in said carrying direction, of said medium increases.

5. A print-control method according to claim 1, wherein said other predetermined carry amount is greater than said predetermined carry amount.

6. A printing system comprising:

a plurality of nozzles that are arranged in a predetermined direction and that are moved in a movement direction;

a medium carrying section that carries a medium in a carrying direction that intersects said movement direction;

a correction value storage section that stores correction values for correcting darkness of each of unit images that are formed in respective unit areas, said unit areas each being oriented in said movement direction and being adjacent to one another in said carrying direction; and a controller that performs:

a first print-control step of repeatedly performing a unit image formation operation of forming said unit images by ejecting ink from said nozzles, and a first carrying operation of carrying said medium by a predetermined carry amount, so as to print an image in an end portion, in the carrying direction, of said medium, and a second print-control step of repeatedly performing said unit image formation operation and a second carrying operation of carrying said medium by an other predetermined carry amount, so as to print an image in an intermediate portion, in said carrying direction, of said medium, that corrects darkness of each of the unit images within said end portion, in which unit images that are printed in said first print-control step, based on an end processing correction value, that corrects darkness of each of the unit images within said intermediate portion, in which unit images that are printed in said second print-control step, is corrected based on a normal processing correction value, and that corrects darkness of each of the unit images within a mixed range, in which unit images that are printed in said first print-control step and unit images that are printed in said second print-control step are mixed in said carrying direction, using an amended correction value obtained by amending the normal processing correction value that is used in said second print-control step.

7. A print-control apparatus for controlling a printing apparatus that is provided with a plurality of nozzles that are arranged in a predetermined direction and that are moved in a movement direction and a medium carrying section that carries a medium in a carrying direction that intersects said movement direction, wherein said print-control apparatus performs:

a first print-control step of causing said printing apparatus to repeatedly perform a unit image formation operation of forming said unit images by ejecting ink from said nozzles, and a first carrying operation of carrying said medium by a predetermined carry amount, so as to print an image in an end portion, in the carrying direction, of said medium, and a second print-control step of causing said printing apparatus to repeatedly perform said unit image formation operation and a second carrying operation of carrying said medium by an other predetermined carry amount, so as to print an image in an intermediate portion, in said carrying direction, of said medium, corrects darkness of each of the unit images within said end portion, in which unit images that are printed in said first print-control step, based on an end processing correction value, corrects darkness of each of the unit images within said intermediate portion, in which unit images that are printed in said second print-control step, is corrected based on a normal processing correction value, and corrects darkness of each of the unit images within a mixed range, in which unit images that are printed in said first print-control step and unit images that are printed in said second print-control step are mixed in said carrying direction, using an amended correction value obtained by amending the normal processing correction value that is used in said second print-control step.

* * * * *